US005917518A

United States Patent [19]

Ohashi et al.

[11] Patent Number: 5,917,518

[45] Date of Patent: Jun. 29, 1999

[54] INK JET RECORDING APPARATUS WITH SUPPORT FOR RECORDING HEAD CARRIAGE

[75] Inventors: Tetsuyo Ohashi; Yoshio Uchikata, both of Yokohama; Masaharu Ikado, Kawasaki, all of Japan

[73] Assignee: Canon Kabushiki Kashia, Tokyo, Japan

[21] Appl. No.: 08/734,309

[22] Filed: Oct. 21, 1996

Related U.S. Application Data

[63] Continuation of application No. 08/083,535, Jun. 30, 1993, abandoned.

[30] Foreign Application Priority Data

| | | | |
|---|---|---|---|
| Jun. 30, 1992 | [JP] | Japan | 4-173413 |
| Jun. 30, 1992 | [JP] | Japan | 4-173416 |
| Jul. 17, 1992 | [JP] | Japan | 4-212308 |

[51] Int. Cl.[6] ..... B41J 23/00

[52] U.S. Cl. ..... 347/37; 400/354

[58] Field of Search ..... 347/37, 12, 33, 347/87; 400/352, 354

[56] References Cited

U.S. PATENT DOCUMENTS

| | | | |
|---|---|---|---|
| 3,890,623 | 6/1975 | Schmid | 346/74.5 |
| 4,227,219 | 10/1980 | Takemoto | 347/37 X |
| 4,313,124 | 1/1982 | Hara | 347/57 |
| 4,345,262 | 8/1982 | Shirato et al. | 347/10 |
| 4,459,600 | 7/1984 | Sato et al. | 347/47 |
| 4,463,359 | 7/1984 | Ayata et al. | 347/56 |
| 4,558,333 | 12/1985 | Sugitani et al. | 347/65 |
| 4,704,619 | 11/1987 | Bierhoff et al. | 400/354 |
| 4,723,129 | 2/1988 | Endo et al. | 347/56 |
| 4,740,796 | 4/1988 | Endo et al. | 347/56 |
| 4,755,836 | 7/1988 | Ta et al. | 347/49 |
| 4,883,375 | 11/1989 | Karube et al. | 400/55 |
| 4,907,018 | 3/1990 | Pinkespell et al. | 347/87 X |

FOREIGN PATENT DOCUMENTS

| | | | |
|---|---|---|---|
| 0098093 | 1/1984 | European Pat. Off. . | |
| 0553561 | 8/1993 | European Pat. Off. . | |
| 0558219 | 9/1993 | European Pat. Off. . | |
| 0562477 | 9/1993 | European Pat. Off. . | |
| 54-158232 | 12/1979 | Japan | 347/37 |
| 59-002855 | 1/1984 | Japan . | |
| 62-251145 | 10/1987 | Japan . | |
| 3132384 | 6/1991 | Japan . | |

*Primary Examiner*—David F. Yockey

*Attorney, Agent, or Firm*—Fitzpatrick, Cella, Harper & Scinto

[57] ABSTRACT

A recording apparatus includes a carriage for carrying a recording head cartridge for effecting recording, and for conveying the recording head cartridge; and a guide for guiding the carriage within a range in which the carriage is conveyed. The carriage includes a slider slidable along the guide, and a contacting device for supporting the carriage by contact with the guide when a large force is imparted on the carriage, while remaining away from the guide during a normal conveying operation.

15 Claims, 28 Drawing Sheets

INK JET RECORDING APPARATUS WITH SUPPORT FOR RECORDING HEAD CARRIAGE

This application is a continuation of application Ser. No. 08/083,535 filed Jun. 30, 1993, now abandoned.

FIELD OF THE INVENTION AND RELATED ART

The present invention relates to an ink jet recording apparatus, in particular, to an ink jet recording apparatus usable with a dedicated printer, copying machine, word processor, personal computer, or facsimile, or a multipurpose machine comprising a combination of these dedicated apparatuses.

Heretofore, the carrier on or from which a head cartridge of an ink jet recording apparatus could be simply mounted or demounted was supported by a lead screw and a guide rail for moving the carrier, and a sliding member of the carrier. Since the head cartridge was directly mounted on or removed from the carriage, the bearings of the lead screw and the sliding member of the carrier were structured to withstand the force imparted on the carrier by an operator.

However, the sliding portion having a large size could not be employed from a standpoint of size reduction, in other words, there was a problem to be solved, that is, it lacked rigidity enough to withstand the force imparted by the operator, when the force was too large.

The prior ink jet recording apparatus had a blade cleaner composed of high polymer absorbent, for removing the ink adhering to a blade employed to wipe the ejection outlet surface. Without this blade, the volatile components of the ink adhering to the blade evaporated on the blade surface, leaving the non-volatile components on the blade surface. The ink from which the volatile components evaporated increased its viscosity so much that it could not be simply removed. Further, when the ejection outlet surface was wiped with a blade to which the ink with such increased viscosity was adhering, it was likely that the ink with increased viscosity was transferred onto the nozzle portion of the head, causing the ink to fail to be ejected or to be poorly ejected (reduction in the ejection amount, or misaimed ink ejection), and resulting thereby in poor printing performance.

Thus, a need for removing the ink adhering to the blade immediately after wiping the blade was confirmed, and as a result, the blade cleaner composed of material such as a high polymer absorbent having water absorbency came to be installed in the apparatus to remove the adhering ink.

However, when the blade cleaner was saturated with the absorbed ink, it could not absorb any more ink, allowing the above described high viscosity ink to adhere to the blade, or in the worst case, allowing the ink to leak out of the blade cleaner and ruin the apparatus.

Therefore, in the prior ink jet recording apparatus, in order to impart the blade cleaner with an absorbing capacity to prevent without a failure the blade from being saturated with the ink, a proper size was determined before the installation. Practically speaking, it was necessary to install an absorbent having a volume of approximately 2 $cm^3$ when 5000 sheets of A4 paper were going to be printed.

However, such a structure as the above made the blade cleaner volume rather large as described, and further, it had a restriction that electrical components could not be disposed near the absorbent because of its nature of absorbing the ink. As a result, the structure invited an increase in the overall size of the apparatus.

Further, when an exchangeable ink container was going to be mounted on the carrier, there were chances of mounting the container in the wrong direction.

There are two types of prior ink jet recording apparatuses, one using the serial recording system in which a recording head having two or more nozzles is mounted on the carrier, and the ink is ejected for printing, from the nozzles while the carrier is moved in the direction substantially perpendicular to the direction in which the recording material is conveyed, and the other using a line recording system in which a number of recording heads having two or more nozzles are arranged so that the direction in which the nozzles are arranged becomes substantially perpendicular to the direction in which the recording material is conveyed, and the ink is ejected for printing as the recording material is moved. In both recording systems, the simultaneous ink ejection from two or more nozzles is avoided to eliminate a need for supplying the recording head with the ink, in a very short time, or a need for supplying the recording head with a large current. Instead, when the ink is ejected, the ink ejection timing is staggered for each nozzle, or each of nozzle blocks into which the nozzles are divided.

However, the ink is ejected while the carrier or recording material is moved, and therefore, when the nozzles are driven in the above described block unit, an ink ejection timing difference directly results in the deviation of recording location.

For example, each nozzle was positioned proportionately off the line perpendicular to the direction in which the carrier is moved, by a predetermined amount $d=v\times t_m$, (v is a conveying speed: $v=R/t_{cycle}$ and $t_m$ is an amount of ejection timing shift of the recording head), in other words, the nozzle alignment line was slightly slanted to compensate for the recording position shift (inclination), as shown in FIGS. 36(*a*) and 36(*b*), so that a recording result as shown in FIG. 39(*a*) was obtained.

However, in the prior art, the amount of shift $t_m$ in the recording head ejection timing was fixed; therefore, when the recording speed was switched to a draft mode speed or the like, for example, to 2v, that is, twice the normal conveying speed, a shift equal to $1=2v\times t_m-v\times t_m=d$ occurred as shown in FIG. 39(*b*).

SUMMARY OF THE INVENTION

The primary object of the present invention is to provide a recording apparatus capable of withstanding the force imparted during the head cartridge exchange operation, without increasing the apparatus size, or preferably while decreasing the size and increasing the reliability.

The second object of the present invention is to provide a blade cleaner which is smaller, and yet capable of storing the waste ink for a prolonged usage, accomplishing thereby the reduction in the overall size of the apparatus.

The third object of the present invention is to provide an ink jet recording apparatus and an ink container which can be relied on for the reliable operation of mounting the container on the carrier or removing it from the carrier.

The fourth object of the present invention is to correct the recording position shift (inclination), providing thereby an ink jet recording apparatus capable of effecting high picture quality recording.

According to an aspect of the present invention, an ink jet recording apparatus comprises: a carriage capable of accommodating an ink jet recording head cartridge for effecting recording by means of ejecting ink, and of conveying the recording head cartridge; and guiding means for guiding the carriage within a range in which the carriage is conveyed, wherein the carriage comprises sliding means for riding on and sliding along the guiding means, and contacting means for supporting the carriage by means of coming in contact with the guiding means only when a large force is imparted on the carriage, while remaining away from the guiding means during the conveying operation.

According to another aspect of the present invention, an ink jet recording apparatus comprises a carriage capable of accommodating an ink jet recording head cartridge for effecting recording by means of ejecting ink, and of conveying the recording head cartridge, wherein the carriage comprises a guiding portion for guiding an ink containing member of the recording head cartridge to a proper position when the ink containing member is mounted.

According to another aspect of the present invention, the ink container comprises an engaging portion which comes in contact with the above mentioned guiding means.

According to another aspect of the present invention, an ink jet recording apparatus comprises a blade for cleaning the ink ejection side surface of a recording head from which the ink is ejected, wherein the blade is connected to a discharge ink absorbing member for absorbing the discharge ink, in such a manner as to allow the ink to be transferred.

According to another aspect of the present invention, an ink jet recording apparatus comprises two or more ink ejecting nozzles aligned at a predetermined angle, wherein the apparatus further comprises means for changing the ink ejection timing for each nozzle according to the degree of the angle and the recording speed.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Referring to the accompanying drawings, the embodiments of the present invention will be described in detail.

Figure 1:
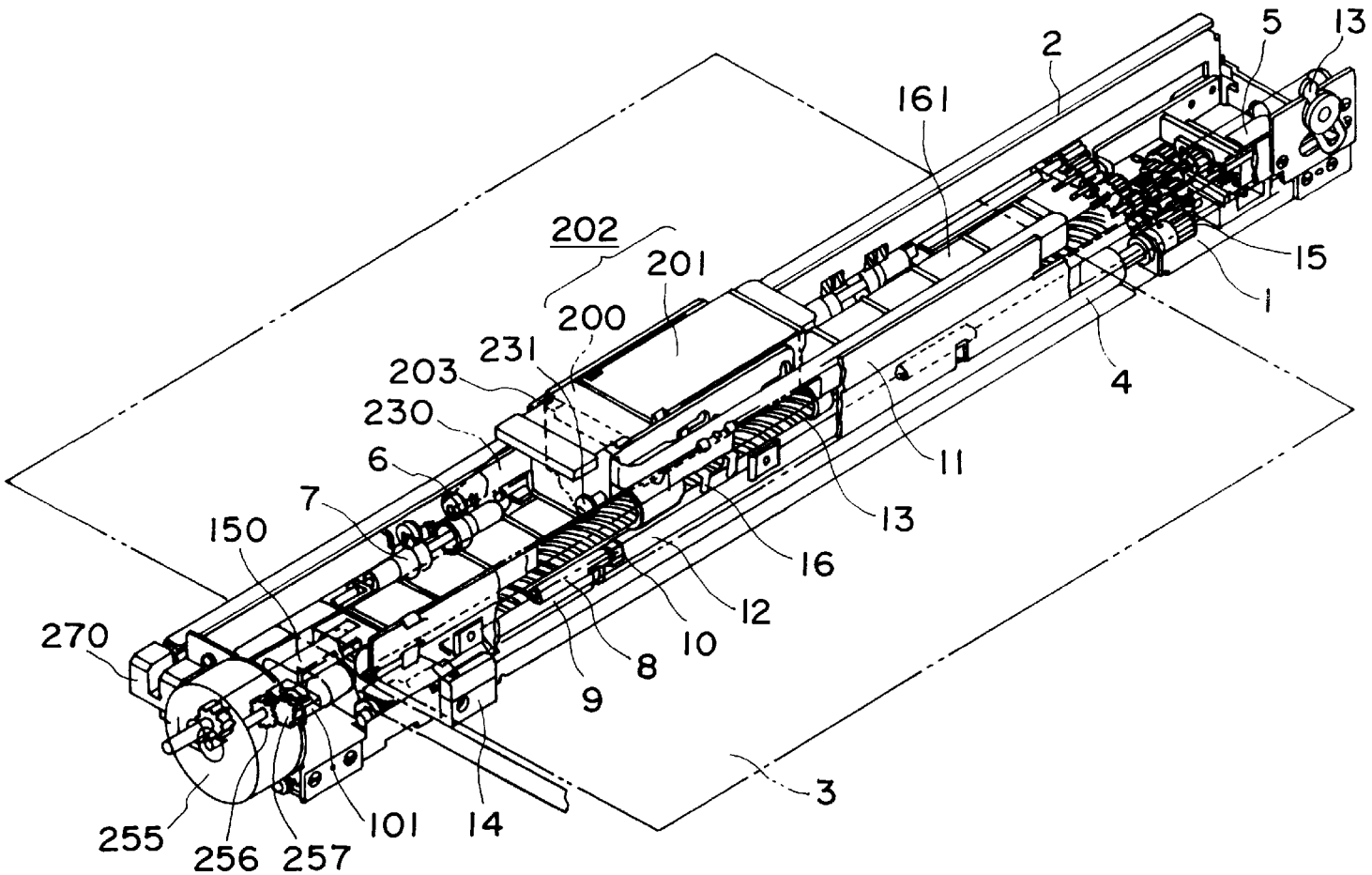
FIG. 1 is a perspective view of a recording apparatus according to a first embodiment of the present invention.

Referring to FIG. 1, there is shown a recording apparatus according to an embodiment of the present invention, in the perspective view. In the figure, a reference numeral 203 designates a carriage for carrying thereon a recording head cartridge 202 having a recording head 200 constituting the recording means and an ink container 202 integral with recording head 200. An end of the carriage 203 adjacent the recording head 200 is engaged with a lead screw 213 for sliding movement in the axial direction, the lead screw 13 being rotatably mounted in a frame 1. The carriage 203 is provided with a guide at another end, and the guide is engaged with a guide rail 2 in the frame 1 for sliding movement in the direction parallel to the axis of the lead screw 213. The carriage 203 is reciprocable in the axial direction with rotation of the lead screw 13, while the pose thereof is maintained constant.

As shown in the figure, a lead screw gear 257 fixed to the left end of the screw and a pinion gear 256 fixed to an output shaft of the carriage motor 255, are in meshing engagement, and a lead screw pin 209 mounted to the carriage 203 is engaged in a guide groove 268 helically formed at a predetermined pitch on the lead screw 213. Therefore, when the lead screw 213 rotates by the forward or backward rotation of the carriage motor 255, the carriage 203 reciprocates. The detail of the scanning operation of the carriage 203 will be described in detail hereinafter.

A flexible cable transmits the printing signal to the recording head 200 from electric circuit which will be described hereinafter. It is supported on a pinch roller frame 11 at a predetermined position by a flexible cable holder 16.

The recording head 203 is moved in synchronism with the reciprocal movement of the carriage 203, and the ink is ejected in accordance with the recording signal, thus effecting recording on the recording material 3 in one line. The recording head 200 comprises fine liquid ejection outlets (orifices), liquid passages, energy application portions in the parts of the liquid passages, and energy generating means for generating energy for formation of liquid droplet.

As for the energy generating means, there are electromechanical transducer elements such as a piezoelectric element, electromagnetic wave generator such as a laser to produce heat to eject the liquid, and electrothermal transducer element in the form of a heat generating resistor or the like to heat the liquid to eject it.

Among them, in a recording head of ink jet recording type in which the liquid is ejected using thermal energy, the liquid ejection outlets for formation of the droplets of the liquid can be arranged at high density, and therefore, a high resolution recording is possible. Particularly, the recording head using the electrothermal transducer element as the energy generating means, can be easily reduced in the size. In addition, the advantages of IC manufacturing techniques and micromachining techniques which have recently significantly been developed and which have recently become reliable, can be used, and therefore, high density arrangement is possible with the advantage of low manufacturing cost.

When one line recording is completed by the scan of the carriage 203, the recording material 3 is fed by one line by feeding means, and the next line recording operation is carried out. The feeding of the recording material 3 is accomplished by a pair of feeding roller 4 and a pinch roller 8 press-contacted thereto, and a pair of discharging roller 7 and spurs 6 contacted thereto.

More particularly, the recording material 3 having a recording surface faced to the ejection side surface of the recording head 200 is press-contacted to the feeding roller 4 by the pinch roller 8, and the feeding roller 4 is rotated by a sheet feed motor 5, by which the recording material 3 is fed through a proper distance. After the recording operation, the recording material is press-contacted to the discharging roller 7 by the spurs 6, and the recording material is discharged to the outside of the apparatus by the rotation of the discharging roller 7.

The feeding roller 4 and the discharging roller 7 are driven by the feeding motor 5 through a reduction gear train 15.

A paper sensor 14 functions to detect presence or absence of the recording material 3. A reference numeral 270 designates a home position sensor, which detects whether the carrier 203 is back at the home position (left side in the figure) before the recording is started.

Figure 2:
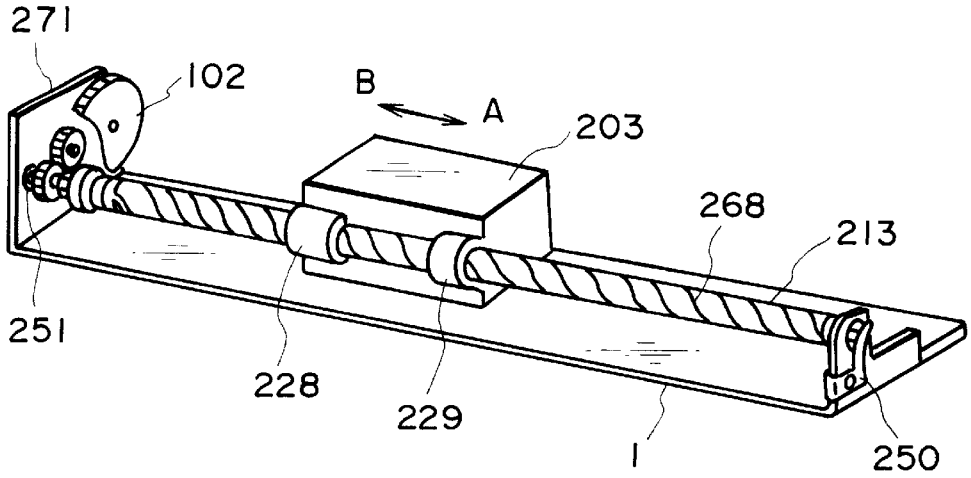
FIG. 2 shows a lead screw mechanism in the apparatus of the first embodiment.

FIG. 2 is a lead screw mechanism for moving the carriage 203 relative to the recording material. Only the members required for its function are shown.

In a lead screw 213 slidably engaged with the carriage bearings 228 and 229 mounted on the carriage 203, the right end of the lead screw 213 is rotatably engaged with the frame 1 by way of adjusting spring 250.

The left end is rotatably engaged with a recovery system plate 271 by way of a bearing 251. A guiding portion (not shown) of the carriage 203 is slidably engaged with a guide rail 2 to guide the carriage 203 without rotation.

The lead screw 213 has plural grooves 268, and one of them slidably receives a lead pin 209 so as to drive the carriage 203 in the directions A or B parallel with the axis of the lead screw 213.

When the carriage motor 255 rotates in the forward direction, the carriage 203 moves in a direction A indicated by an arrow in FIG. 2. When it rotates in the backward direction, the carriage 203 moves in a direction B.

A home position sensor 270 (FIG. 1) is mounted to the recovery system plate 271, and the carriage 203 is scanned by rotation of the carriage motor 255. The detection of a light blocking plate 230 (FIG. 1) of the carriage 203 passing through the home position sensor, may be used as a reference for the recording operation and a recovery operation which will be described hereinafter.

Figure 3:
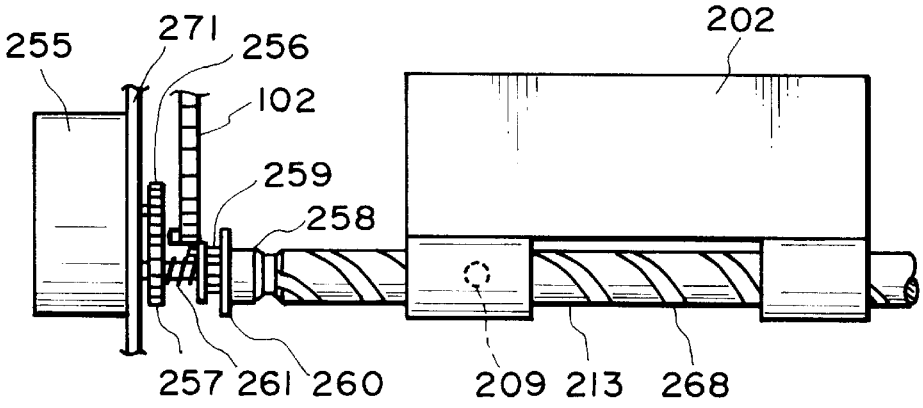
FIG. 3 illustrates operation of a clutch mechanism in the first embodiment apparatus.

FIG. 3 illustrates an operation of a clutch mechanism for transmitting the driving force from the carriage motor 255 to the recovery system. One end of the lead screw 213 is connected to the clutch mechanism.

Figure 4:
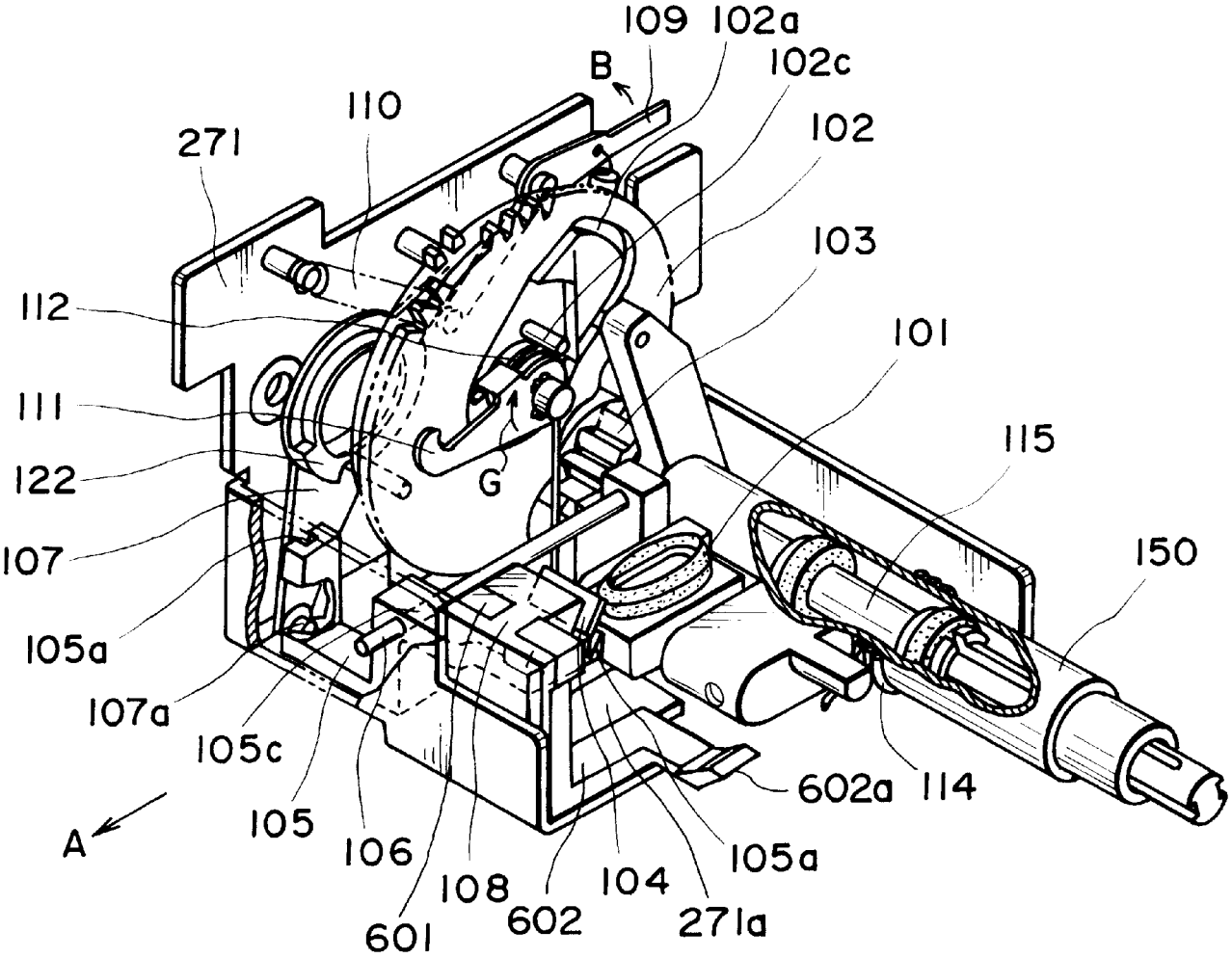
FIG. 4 illustrates a recovery device in the first embodiment apparatus.

FIG. 4 is a perspective view of a recovery mechanism of a recording apparatus of this embodiment.

In this figure, it comprises a cap 101 for capping the ejection side surface of the recording head 200, a pump unit 150 for creating a negative pressure and thereby sucking the ink from the ejection side surface through the cap 101 and discharging the ink to a discharge ink absorbing material, and a control gear 102 for a drive transmission including cam and gear mechanism to move the cap 101 toward and away from the ejection side surface, to transmit the driving force to the pump unit 150 and to operate a wiping mechanism for wiping the ejection side surface to remove the ink thereon. The control gear 102 is supplied with a rotational driving force from the carriage motor 255 through the clutch gear 259.

The description will be made as to how to drive the recovery means by the rotation of the control gear 102.

The control gear 102 is provided with a cap moving cam 102*a* and a wiping operation cam (not shown). As shown in FIGS. 3 and 4, it is in meshing engagement with a stroke gear 103 for reciprocating the plunger 115 which will be described hereinafter. The rotation of the control gear 102 rotates the stroke gear 103 to reciprocate the plunger 115.

Figure 6:
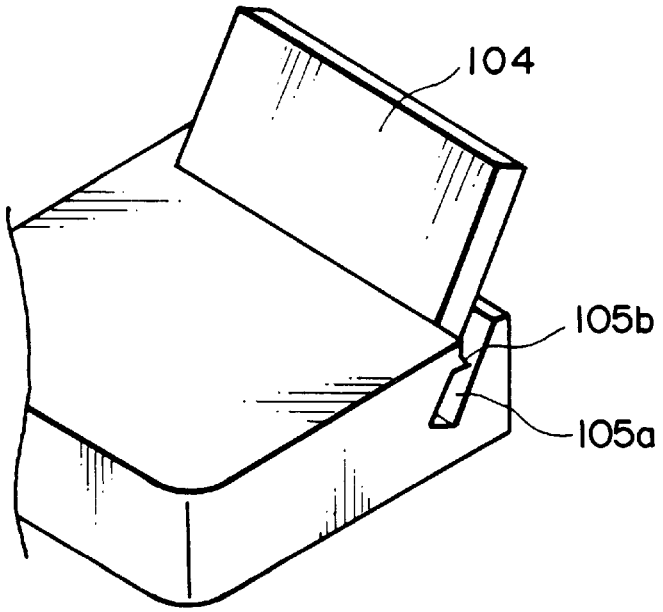
FIG. 6 is a perspective view of a blade mounted in the first embodiment apparatus.

In FIG. 4, the blade 104 functions to wipe the ejection side surface of the recording head 200 to clean the ink ejection side surface. The blade 104 is made of HNBR or urethane rubber or the like. It is mounted by sliding insertion of an end into a blade mounting groove 105*a* of the blade slider 105. As shown in FIG. 6, the blade mounting groove 105*a* is provided with a projection 105*b* having an acute angle edge to prevent release of the blade. Therefore, even if force is applied tending to pull out the blade 104 during the wiping operation, it is not pulled out because of the projection 105*b*.

The blade slider 105 is provided with a through hole 105*c* to be movable along a sliding shaft 106 parallel to the ejection side surface of the recording head. Because of the reciprocal motion along the slide shaft 106, the entering distance of the blade 104 to the recording head 200 is always constant irrespective of the position on the ejection side surface, and the ejection surface is uniformly wiped.

The reciprocal motion of the blade slider 105 is carried out by a blade link 107. The blade slider 105 is reciprocated by a projection 107*a* of the blade link 107 pushing a wall 105*a* of the blade slider 105. The blade link 107 is controlled in its motion by a wiping cam (not shown) formed in the control gear 102.

When the ejection side surface of the recording head 200 is wiped by the motion of the blade slider 105, the ink deposited on the blade 104 is transferred to a blade cleaner 108 so that the blade 104 is maintained in clean state. After the blade 104 moving in the direction A in FIG. 4 for wiping operation has covered all the ejection side surface, it is contacted to the blade cleaner 108, upon which the ink on the blade is absorbed by the blade cleaner 108.

Figure 7:
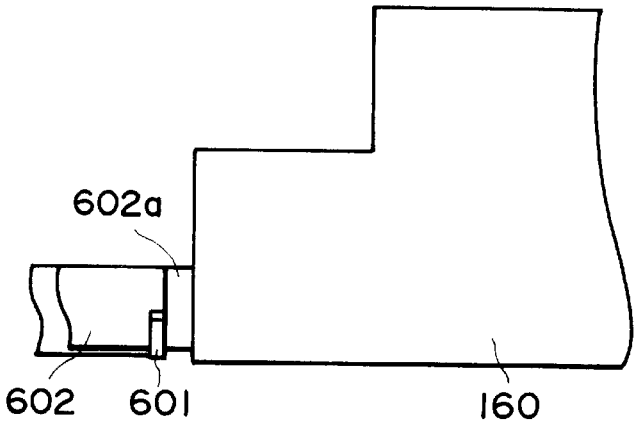
FIG. 7 schematically illustrates how an ink transfer sheet and a waste ink absorbent are connected.

The blade cleaner 108 is placed in contact with an ink transfer sheet 602 by a cleaner spring 601, constituting a part of a blade cleaner unit. This blade cleaner unit is attached to a recovery system unit 271 in such a manner as for the blade 104 to arrive to a position where it comes in contact with the blade cleaner 108 as it moves the maximum distance in the direction indicated by an arrow A in the figure. Further, it is structured so that an ink transfer portion 602*a* of the ink transfer sheet 602 comes in contact with the waste ink absorbing member 160, which will be described later, (FIG. 7). With such a contact, the ink transferred from the blade 104 to the blade cleaner 108 moves to the waste ink absorbing member through the ink transfer sheet 602, preventing thereby the ink cleaner 108 and ink transfer sheet 602 from becoming saturated with the ink, which in turn enables the ink adhering to the blade 104 to be constantly absorbed, and enables thereby the blade 104 to be kept clean.

Figure 8:
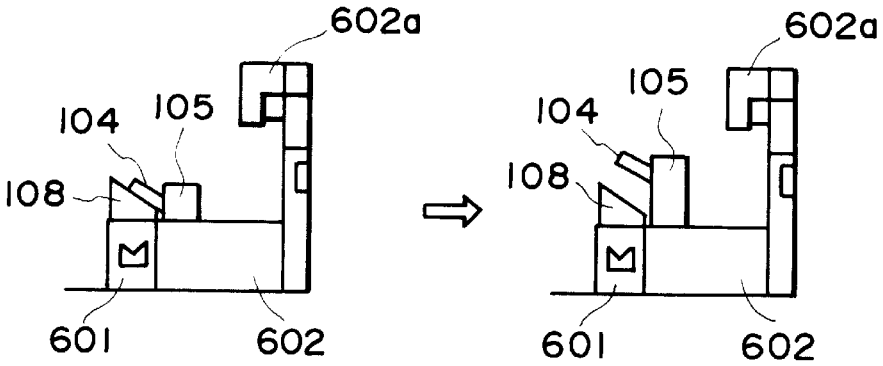
FIG. 8 is a schematic view of the ink transfer sheet and a blade cleaner.

If the blade 104 remains in contact with the blade cleaner 108, the blade is deformed due to the creep phenomenon of the rubber, and loses its ability to function as it is intended. Therefore, the blade 104 is moved in the direction reverse to the arrow A direction in the figure by the wiping operation cam of the control gear 102 after the blade 104 contacts the blade cleaner 108, so that the blade 104 is separated from the blade cleaner 108 to prevent the blade 104 from being subjected to an external force (FIG. 8).

In FIG. 4, a reference numeral 111 designates a carriage stopper which is effective to prevent the carriage 203 from popping out to the recording range by vibration or impact thereto. The carriage stopper 111 is normally urged in a direction of an arrow G in FIG. 4 by a carriage hook spring 112. During the recording operation, it is retracted from the carriage hook 231 by a projection 102*c* of the control gear 102.

The operation will be described. When the lead pin 209 of the carrier 203 enters the idle groove 264, and the control gear 102 starts to rotate, the projection 102*c* of the control gear 102 moves away from the carrier stopper 111. The carrier stopper 111 then rotates in the direction G in FIG. 4 to be engaged with the carrier hook 231. Therefore, in the rest state not performing the recording operation, the carriage stopper 111 is engaged with the carriage hook 231 to prevent the carriage 203 from moving to the recording position.

In addition, the carriage stopper 111 also functions to prevent disengagement of the control gear 102 from the shaft, as by an E ring.

Figure 5:
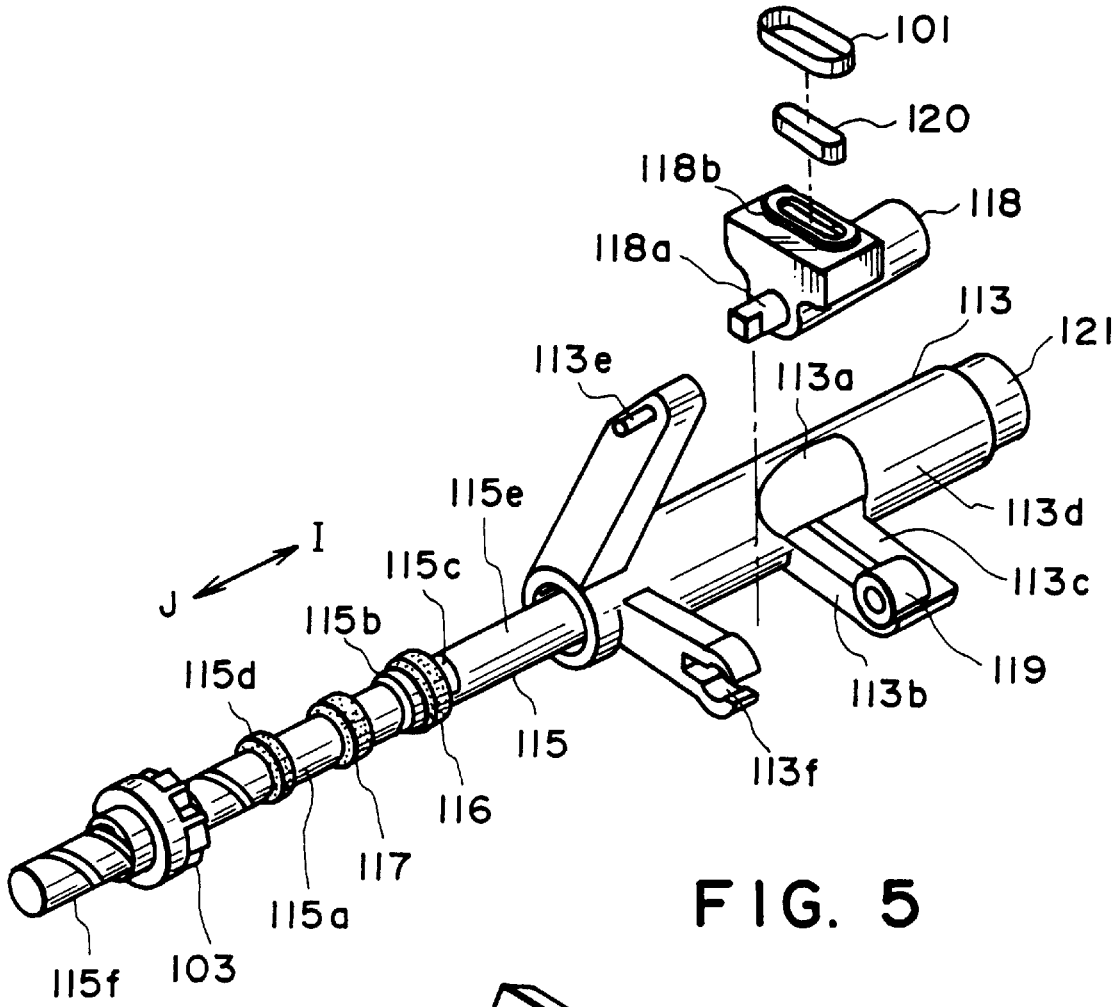
FIG. 5 illustrates a pump unit in the first embodiment apparatus.

The pump unit 150 has a plunger pump structure, as shown in FIG. 5.

In FIG. 5, a reference numeral 113 designates a cylinder which comprises a cylindrical portion 113*a*, and a guide (not shown) for guiding a plunger 115 which will be described. It is partly cutaway in the axial direction to provide an ink path. A cap lever receptor 113*b* is formed to receive and engage with the cap lever seal which will be described hereinafter. An ink sucking port 113*c* opens at a predetermined position. An ink discharge pipe 113*d* is integrally formed, and the end thereof is inserted into the discharge ink absorbing material. Designated by a reference numeral 113*e* is a parallel pin for opening and closing the cap. When the parallel pin 113*e* is pushed by the cap moving cam 102*a* of the control gear 102, the cylinder 113 rotates to move the cap 101 to and away from the ejection side surface of the recording head 200.

Figure 9A:
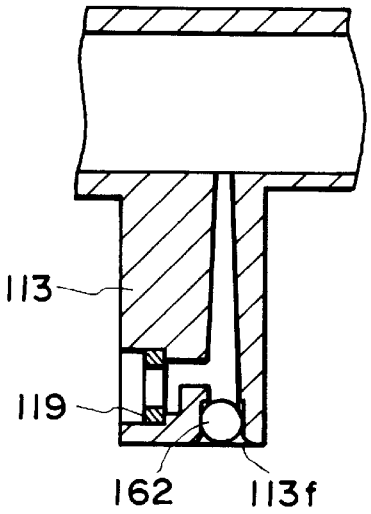
FIGS. 9A and 9B are schematic views of a cylinder opening.
Figure 9B:
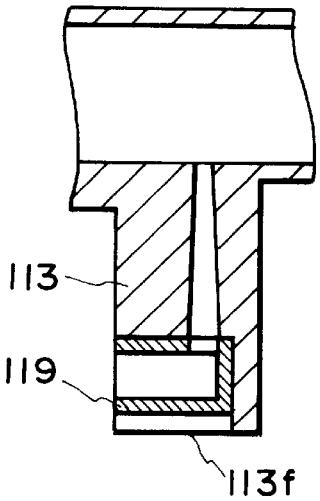

Referring to FIG. 9A, a steel ball 162 is press fitted in an opening 113*f* of the ink sucking port 113*c* of the cylinder 113. In the prior art, this portion was sealed as shown in FIG. 9B by a part of the cap lever seal 119. However, in this case, not only the shape of the cap lever seal becomes complicated, but also, the cylinder opening 113*f* was poorly sealed, creating a problem of leaking. In order to solve this problem, the cap lever seal 119 was enlarged to increase the force by which the seal was pressed on the cylinder 113, preventing thereby the leak. However, since such a measure was taken, the rotative force of the cap lever 118 inserted in the cap lever seal 119 increased, and as a result, the cap pressing force was reduced, which was a problem.

This problem was swept away by means of sealing the opening 113*f* of the cylinder 113, with the use of the stainless steel ball 162 as this embodiment. Also, it became possible to shape the cap lever seal 119 to be an O ring, and therefore, the problems involving both formability and assembly of the seal were minimized at the same time.

Figure 10:
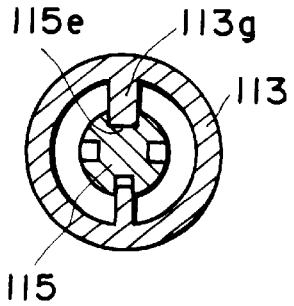
FIG. 10 is a schematic view of an ink passage groove in a plunger.
Figure 11:
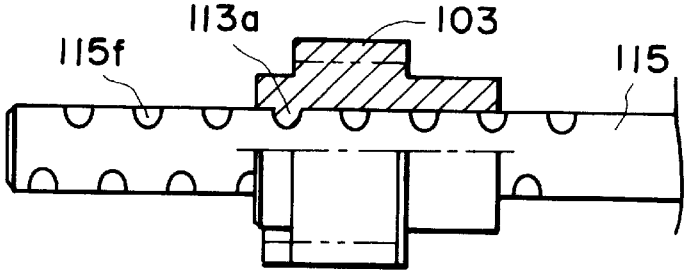
FIG. 11 is a schematic view of a lead groove in the plunger.
Figure 12A:
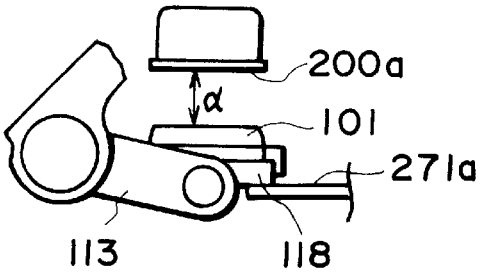
FIGS. 12A, 12B, 12C and 12D are schematic views of cap lever, depicting its movement.
Figure 12B:
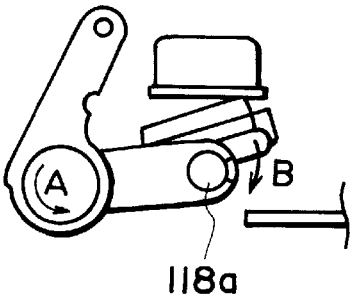
Figure 12C:
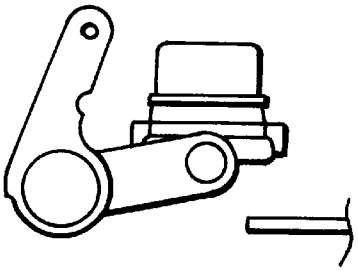
Figure 12D:
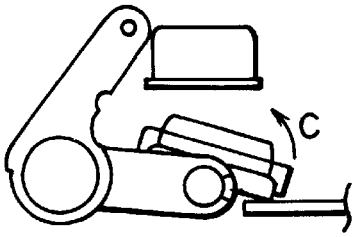

The plunger 115 comprises an operational shaft 115*a*, piston seat 115*b*, piston holder 115*c*, and pump seal holder 115*d*, wherein a continuous groove 115*e* which serves as the ink flow passage is formed in the operational shaft 115*a*. A portion of this groove is engaged with a guide member 113*g* of the cylinder 113 (FIG. 10), preventing thereby the rotation of the plunger 115. The operational shaft 115*a* has a lead groove 115*f* for controlling the reciprocal movement of the plunger 115, and a projection 103*a* formed on the inner surface of the stroke gear 103 is engaged with this lead groove 115*b* (FIG. 11). Therefore, when the stroke gear 103 is turned in one direction by the reverse driving of the carrier motor 255, the plunger 115 strokes in the direction indicated by an arrow I in FIG. 5, and when the stroke gear 103 is turned in the other direction by the forward driving of carrier motor 255, the plunger 115 strokes in the direction indicated by an arrow J in FIG. 5.

As described above, use of the lead groove 115*b* and stroke gear 103 for controlling the stroke of the plunger 115 can eliminate the cam and linking mechanism required in the prior art, which makes it possible to reduce the apparatus size.

FIG. 12 is a schematic view of the cap lever 118, depicting its movement as the cap 101 is placed or removed. When the cap 101 is off the ejection side surface 200*a* of the head (FIG. 12(*a*)), the cap lever 118 is kept parallel to the ejection side surface by a cap controlling plate 271*a* of the recovery system plate 271. Therefore, a gap α is created between the cap 101 and the ejection side surface of the head, which enables the blade slider 105 to pass through this gap α, and allowing thereby blade 104 to wipe the ejection side surface.

Next, when the cap 101 is going to tightly seal the ejection side surface of the head, the cylinder 113 is rotated by the cap moving cam of the control gear 102 in the direction indicated by an arrow A in the figure while the angle between the cap lever 118 and cylinder 113 is kept constant as shown in FIG. 12(*b*), and as the cylinder 113 is rotated, the cap lever 118 approaches the ejection side surface of the head, eventually making one end of the cap 101 come in contact with the ejection side surface as shown in FIG. 12(*b*). The contact generates a moment in the cap lever 118 in the direction indicated by an arrow B in the figure, whereby the cap lever 118 is rotated about the axis 118*a* until the cap 101 finally seals the entire surface on the ejection side of the head, and then, holds itself as shown in FIG. 12(*c*).

By causing the same spot of the cap 101 to always make the first contact with the ejection side surface of the head as described above, the differences in contact angle and contact location between the cap and ejection side surface, which occurs due to the variance in the manufacturing process, can be absorbed to seal securely the ejection side surface of the head. This art offers an effective means for an ink jet recording apparatus, in particular, for the one employing an exchangeable ink jet cartridge. Also, since the ejection side surface can be securely sealed with the cap 101 even when the reduction of the apparatus size fails to offer a sufficient contact pressure between the cap 101 and ejection side surface of the head, the art offers an extremely effective means.

When the cap 101 is retracted away from the ejection side surface of the head, a portion of the cap lever 118 comes in contact with the cap controlling plate 271*a* of the recovery system plate 271, generating thereby a moment in the direction indicated by an arrow C, whereby the cap lever 118 is rotated about the axis 118*a* until it finally realizes the state shown in FIG. 12(*a*).

Figure 13:
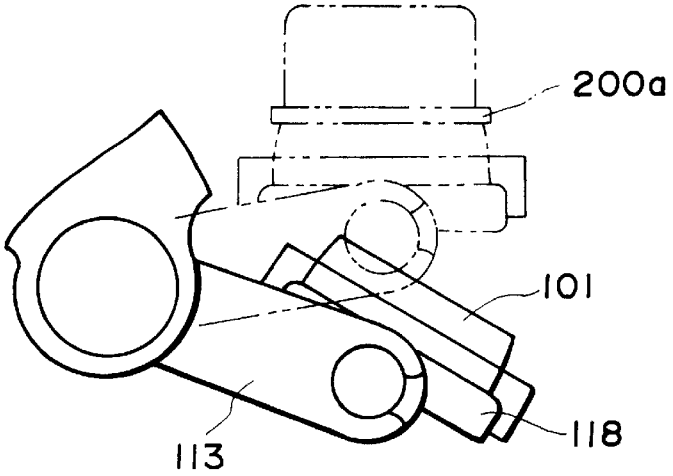
FIG. 13 is a schematic view of the cap lever according to the prior art.
Figure 14:
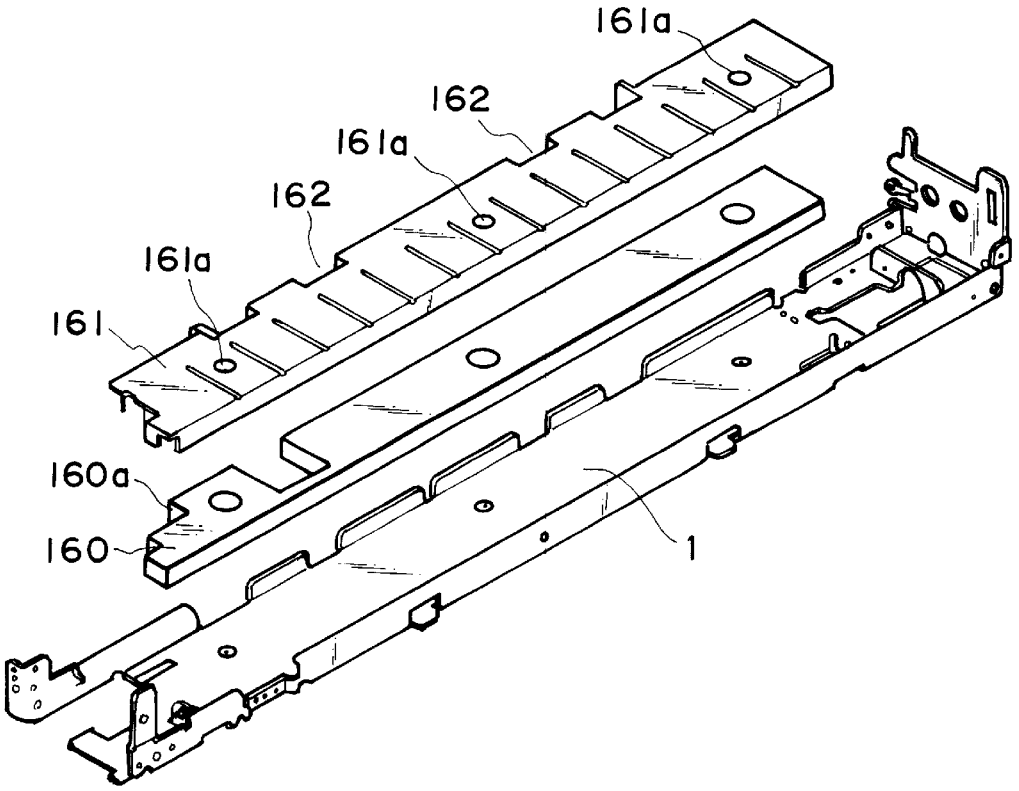
FIG. 14 is a schematic view of a discharge ink absorbent member.

As for the prior art, it is described referring to FIG. 13. As is evident from this figure, according to the prior art, the angle formed by the cap lever 118 and cylinder 113 is fixed, and therefore, the retraction distance of the cap is longer.

Thus, the art in which the rotation of the cap lever 118 is utilized is an indispensable art for reducing the size of the ink jet recording apparatus.

On the plunger 115, a piston 116 composed of rubber material such as NBR is fixed. The external diameter of this piston 116 is larger than the internal diameter of the cylinder 113, by a predetermined amount, so that it is compressed by a proper amount when inserted into the cylinder 113. In this embodiment, the internal diameter is Φ 4.9 and the external diameter of the piston 116 is Φ5.05±0.05. With these sizes, this amount of compression is most appropriate. The hardness of the rubber is preferred to be 40°–60° JIS. With this arrangement being in place, when the plunger 115 strokes in the direction indicated by the arrow I in FIG. 5, a negative pressure is generated in the cylinder to suck the waste ink within the recording head 200, and when it strokes in the direction indicated by the arrow J, the absorbed waste ink is discharged to the discharge ink absorbing member 160 through the ink discharge pipe 113*d*.

The plunger 115 is provided with the pump seal 117, which is made of rubber material such as silicone rubber or NBR. Its internal diameter is made to be slightly smaller than the external diameter of the plunger 115, so that a predetermined amount of contact pressure can be generated against the plunger while allowing itself to be reciprocated within the cylinder as it is pushed by the pump seal holder 115*d* or piston seat 115*b*. In the case of this embodiment, the external diameter of the plunger is Φ2.8f10, and the internal diameter of the pump seal 117 is Φ2.65±0.05. With these sizes, this amount of compression is appropriate. The hardness of the rubber is preferred to be 40°–60° JIS. The friction between the cylinder 113 and plunger 115 may be reduced by coating the surfaces of both components with a lubricant. Also, rubber material having self lubricating properties may be employed to avoid the lubricant use in the cylinder.

Reference numeral 120 designates an auxiliary ejection pad which is made of high polymer absorbent as the above described blade cleaner 108, and it is mounted on the cap lever 118. This auxiliary ejection pad is for absorbing the ink ejected during the auxiliary ejection operation which is performed during the recording operation, in addition to the normal recording operation, to prevent the ejection side surface from drying up.

A reference numeral 121 designates a pump absorbent, which is a high polymer absorbent functioning to transfer reliably the waste ink within the cylinder to the discharge ink absorbing member.

Figure 15:
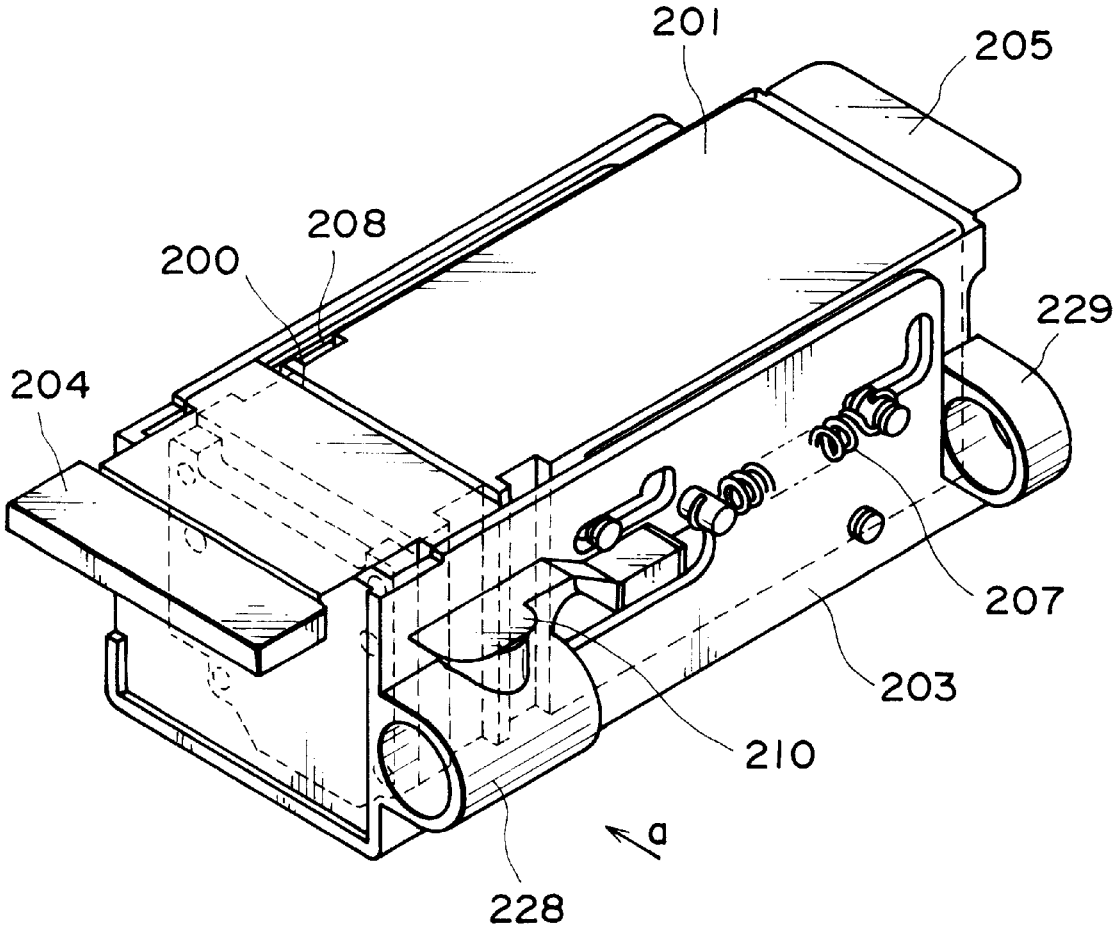
FIG. 15 is a perspective view of a carriage in the first embodiment apparatus.

FIG. 15 is a perspective view of the head cartridge and the carriage of the recording apparatus according to this embodiment of the present invention. In this figure, reference numeral 200 designates a recording head for ejecting the ink in accordance with electric signal; 201, an ink container for containing the ink to be supplied to the recording head; 203, a carriage in the main assembly of the apparatus effective to carry the recording head 200 and the ink container 201; 204, a head lever for supporting and releasing the recording head; 205, an ink container lever for detachably mounting the ink container 201; 207, a head holder spring for fixing the recording head 200 to the carriage 203; 208, a container case for supporting the ink container 201. By these elements, the head cartridge and the carriage are constituted.

Figure 16:
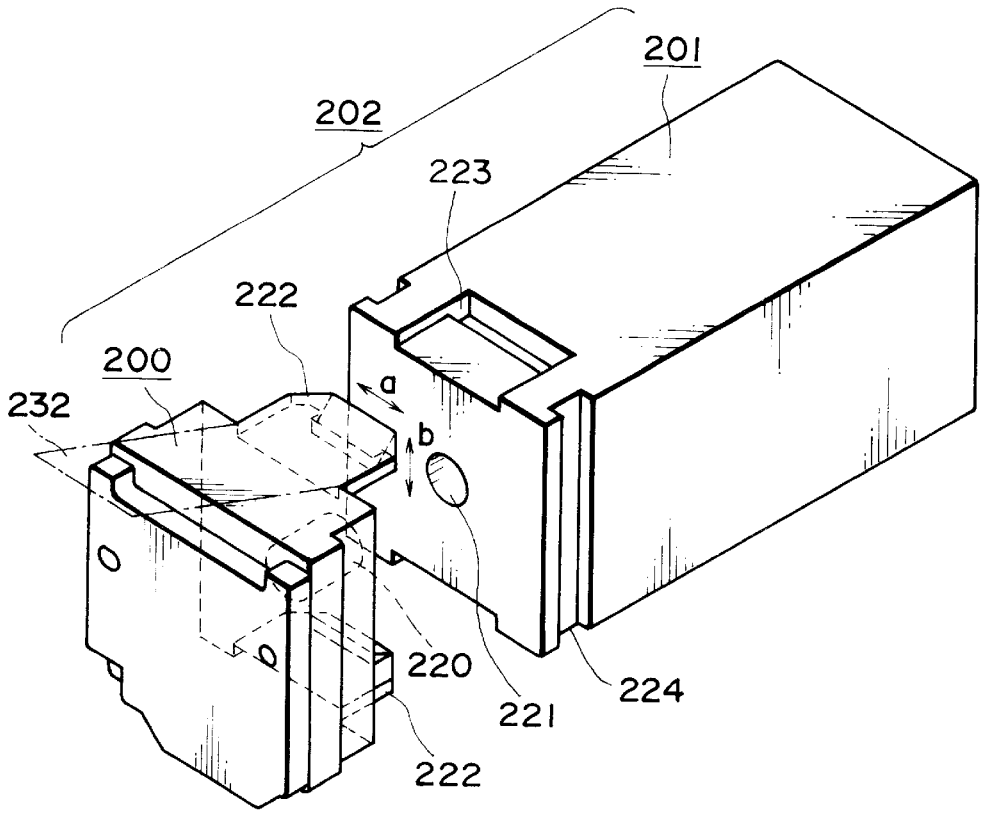
FIG. 16 is a perspective view of a head cartridge in the first embodiment apparatus.

FIG. 16 is a perspective view of the recording head 200 and the ink container 201 of the recording apparatus according to this embodiment. In this figure, reference numeral 220 designates an ink supply port functioning as a passage for supplying the ink from the ink container 201 to the recording head; 221, an ink supply port for supplying the ink from said ink container 201 to said recording head 200; 222, a connecting pawl for guiding and supporting the recording head 200 and the ink container 201 which are integral with each other. Reference numeral 223 designates a connecting pawl guiding groove engageable with the connecting pawl 222; and 232, a head tab for facilitating the removal operation when the recording head is removed from the carrier. The head cartridge 202 is constituted by these elements.

The recording head 200 comprises a base plate having a plurality of electrothermal transducer elements for producing thermal energy used for ink ejection and driving circuit for driving them, a top plate for forming ejection outlets and liquid passages corresponding to the respective electrothermal transducer elements and for forming a common liquid chamber communicating with the liquid passage, and electric contacts for supplying electric signals from the main assembly to the driving circuit. The recording head 200 may be provided with sensors for permitting the main assembly of the recording apparatus to detect the states of the recording head. More particularly, the sensors include a temperature sensor for detecting the temperature of the recording head in the neighborhood of the electrothermal transducer elements, an ink sensor for detecting a remaining amount of the ink in common liquid chamber, and a head identification sensor for identification of types of the head cartridge when different types of heads are exchangeably usable. The signals from the sensors are discriminated by the main assembly of the recording apparatus, and the signals applied to the electrothermal transducer elements are controlled, accordingly, thus providing the optimum printing conditions.

The ejection side surface having the ejection outlets of the recording head is faced to the recording material in the recording apparatus.

An ink container 201 functions to contain the ink to be supplied to the recording head 200 in accordance with consumption with the ink for the recording operation. When it is alone, an ink supply port 221 thereof is sealed by an unshown sealing means to prevent leakage of the ink. The sealing means is automatically or manually removed when the ink container 201 is mounted to the recording means. by doing so, the ink passage is connected. The sealing means may be in the form of metal ball urged to an opening of rubber.

The ink container may be provided with a mechanism for introducing external air in accordance with reduction of the ink volume resulting from consumption of the ink. In addition, a structure for maintaining slight vacuum in the ink may be provided in the container, thus improving the print quality and preventing the ink leakage.

In this embodiment, the ink container 201 contains a flexible bladder in which the ink is accommodated. The bladder is in communication with the ink supply port 221. the remaining space in the ink container 201 is filled with air. The air pressure is adjusted by an unshown pressure control valve in the recording operation. Further particularly, a vacuum in a predetermined range is produced and maintained.

In order to realize the above described pressure regulating mechanism by employing a simple structure, an ink absorbing member made of sponge material may be placed within the ink container 201, so that the ink is retained by the ink absorbing member. In this case, the ink is subjected to the capillary force working to retain the ink within the ink absorbing member itself, and therefore, the ink can automatically generate and maintain the negative pressure as it is consumed against this capillary force. Also, in this case, an air vent is provided on the ink container 201 so that the air is taken in from outside the ink container 201 by a volume equal to the amount of the consumed ink.

The recording head 200 and the ink container 201 are used while they are integral during the recording operation. The description will be made as to making them integral.

Fundamentally, the recording head 200 and the ink container 201 are made integral by communicating the ink receiving port 220 and the ink supply port 221. Therefore, the connecting portion is of such a structure to prevent the ink leakage or the introduction of the air into the ink passage.

The container system is not limited to the combination of the rigid material and the elastic material. It will suffice if the suitable sealing performance is provided. For example, a combination of a molded pipe and a molded member having a hole is usable in which the sealing is provided using elasticity due to fine deformation of the mold. As another example, the connection may be established using a rubber sealing member without a hole and an injection needle.

The unification of the recording head 200 and the ink container 201 may be established only by the connection between the ink receiving port 220 and the ink supply port 221. However, in order to prevent them from disconnecting from each other upon unexpected impact applied thereto during handling of the head cartridge 202, or the like, and/or in order to ease unification, there are provided a locking pawl 222 and a locking pawl guiding groove 223. The locking pawl 222 is integrally molded with the ink receiving port 220 and is capable of elastic deformation. It has a projection at its end. It is engaged with the guiding groove 223 while being elastically deformed by the height of the projection. The locking engagement is established at the time when the projection of the locking pawl 222 reaches the portion of the guiding groove 223 which is deeper.

The locking pawl 222 also has a function as a guide so that the ink receiving port 220 and the ink supply port 221 are easily aligned upon connection between the recording head 200 and the ink container 201. More particularly, the locking pawl 222 is longer than the ink supply port 220. Before the ink receiving port 220 is contacted to the ink supply port 221, the locking pawl 222 is contacted to the ink container 201. The leading edge of the locking pawl 222 is cut with the inclination. The inclined portion functions as a guide in the direction a in FIG. 16 to permit easy engagement. The projection at the end of the locking pawl 222 is cut also with inclination to function and as a guide in the direction b in FIG. 16 to facilitate the engagement action.

In this embodiment, the locking pawl is provided on the recording head, but this arrangement is not limiting. It may be provided on the ink container 201 or on both of the recording head 200 and the ink container 201 (refer to FIG. 18).

The description will be made as to the mechanical and electrical connection between the recording head 200 and carriage 203.

Figure 17:
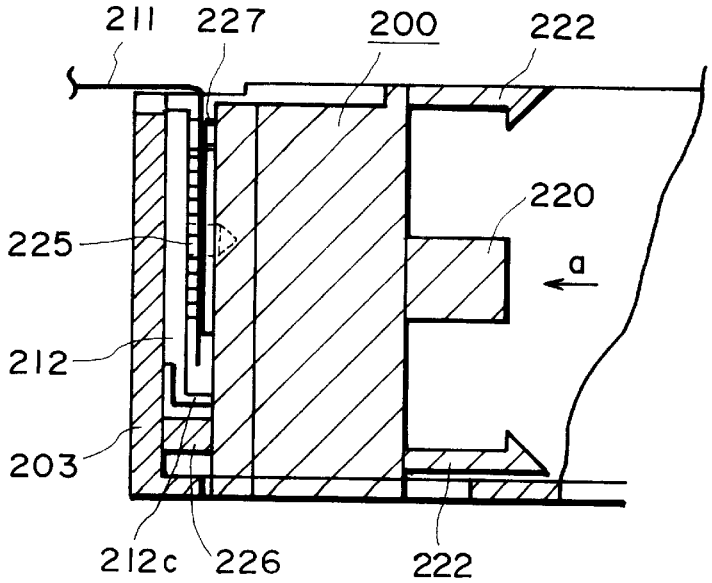
FIG. 17 is an enlarged partial sectional view of the carriage in the first embodiment apparatus.
Figure 19:
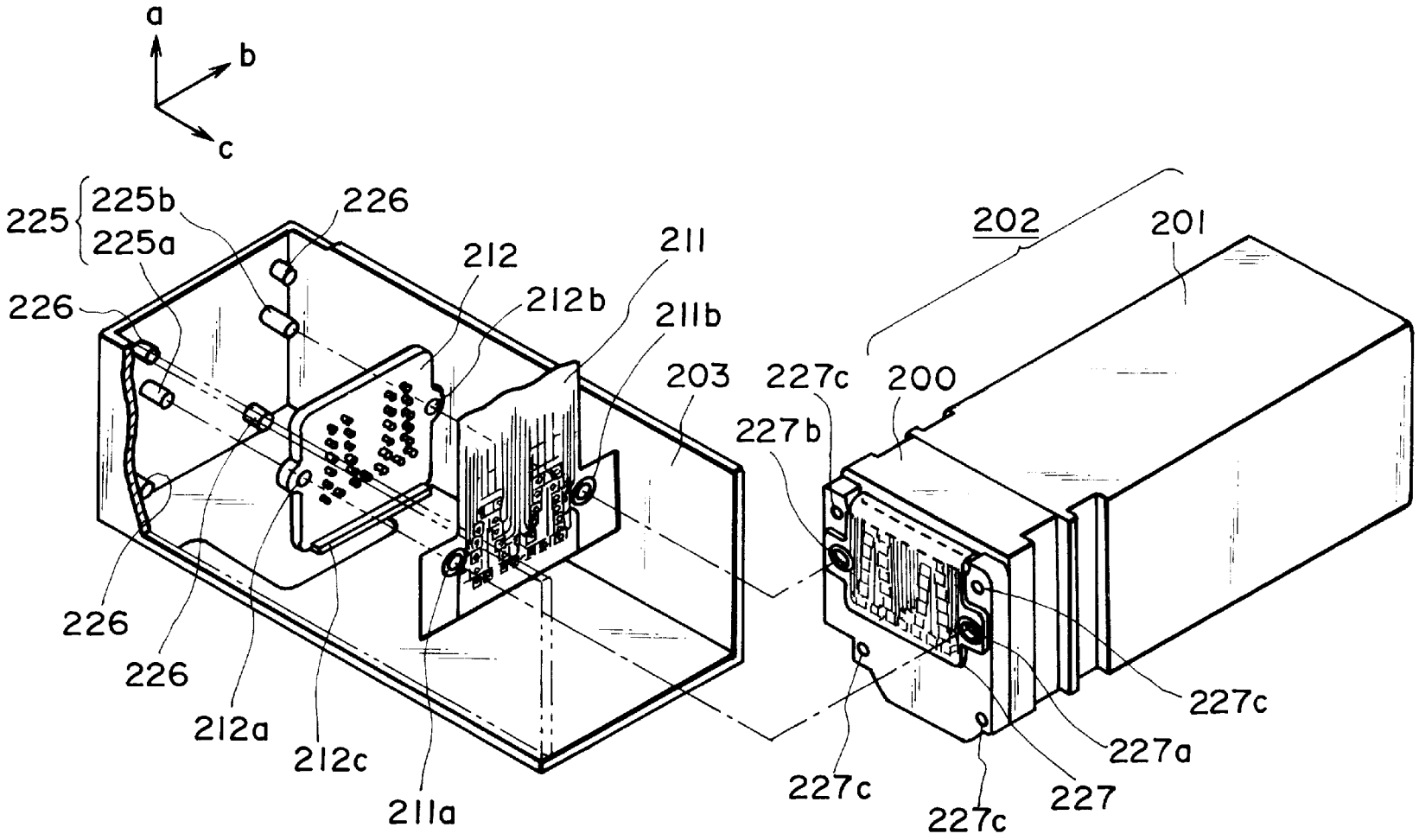
FIG. 19 is a perspective view illustrating connection between the carriage and the head cartridge in the first embodiment apparatus.

FIG. 17 is a sectional view taken along a line a in FIG. 15, illustrating the connection between the carriage 203 and recording head 200. FIG. 19 is a perspective view illustrating the process. In the figures, reference numeral 225 designates positioning pins engageable with corresponding holes of a recording head on the carriage 203 to accurately position the recording head 200 in a direction a and a direction b in FIG. 19; 226 designates a stopper fixed on the carriage 203 to stop the recording head 200 urged in the direction a in FIG. 17; 211 is a flexible cable for electrically connecting the recording head 200 and the main assembly of the recording apparatus; 211*a,* a positioning hole in the flexible cable 211; 211*b,* a positioning hole in the flexible cable 211; and 212, a flexible cable pad elastically supporting the flexible cable 211 and sandwiched between the flexible cable 211 and the carriage 203. In addition, reference numeral 212*a* designates a positioning hole in the flexible cable pad 212; 212*b,* a positioning hole in the flexible cable pad 212; 212*c,* an ink barrier for preventing ink entrance to the contact position; 222, a head contact portion electrically connected with the heater in the recording head 200; 227*a,* a positioning hole in the head contact 227; 227*b*, a positioning hole in the head contact portion 227; and 227*c,* a stopper abutment for abutting with the end surface of the stopper 226.

The recording head 200 is urged in the direction a through an unshown lever by the head holder spring 207. The position thereof is definitely determined by the engagement between the hole of the recording head 200 and the positioning pin 225 and by the interference with the stopper 226. In this manner, the recording head 200 and the carriage 203 are mechanically connected.

On the end surface of the head contact portion 227 of the recording head 200 and the flexible cable 211, there are provided corresponding plural electric contacts. They are pressed to each other with a predetermined pressure, so that the main assembly of the recording apparatus and the recording head 200 are electrically connected. It is necessary that the respective contacts are pressed at once. For the purpose of uniform pressing, there is provided a flexible cable pad 212 of elastic material. The material of the flexible cable pad 212 is of silicone rubber. It comprises plural projections at positions corresponding to the electric contacts to concentrate the pressure on the contact points. The electric contacts of the flexible cable 211 may be in the form of projections in order to further assure the pressure concentrated on the contact points.

Since the reaction force produced upon the pressing is designed to be far smaller than the force of the head holder spring 207 for urging the recording head 200, and therefore, the recording head 200 is prevented from deviation by the reaction force from the flexible cable pad 212.

The carriage 203, the flexible cable pads 212, the flexible cable 211, the head contact portion 227 and the head cartridge 203 are required to be correctly positioned relative to each other in order to assure the electric connection and the high print quality. In order to accomplish this, the following structure is used.

One of the positioning pins 225 commonly engages with the positioning hole 212*a*, the positioning hole 211*a* and positioning hole 227*a,* and the other positioning pin 225 commonly engages with the positioning hole 212*b,* the positioning hole 227*b,* by which the positioning in the directions a and b in FIG. 19 are accomplished.

In addition, by urging in the direction a in FIG. 17 until the end surface of the stopper 226 abuts the stopper abutment portion 227*c* of the head contact 227, the position, in the direction c of the recording head 200 can be correctly determined.

In addition, if the ink enters, for one reason or another, between the flexible cable 211 and the head contact portion 227 (electric contact surface), the electric short circuit may occur. Therefore, it is desired to prevent this. In this embodiment, a part of a flexible cable pads 212 is projected so as to function as an ink barrier 212*c,* and it is urged to the end surface of the recording head 200, thus preventing the ink from the recording head 200 from entering.

In this embodiment, the electric and mechanical connections are provided in the recording head, but this structure is not limiting. They may be provided in the ink container 201 or recording head 200. The electric connection and the mechanical connection may be provided on one part and on the other part, respectively.

The description will be made as to method of exchanging the recording head 200 and the ink container 201, for example, when the ink container 201 is exchanged with a fresh ink container after it is used up, or when the recording head 200 is exchanged upon necessity arising when it becomes inoperable for one reason or another.

In one mode, the locking between the recording head 200 and the carriage 203 is released, and the recording head 200 and the ink container 201 are taken out integrally or as a unit, from the carriage 203. After they are taken out as a unit from the carriage 203 (off-carriage state), the recording head 200 and the ink container 203 are separated or unified relative to each other.

Figure 20:
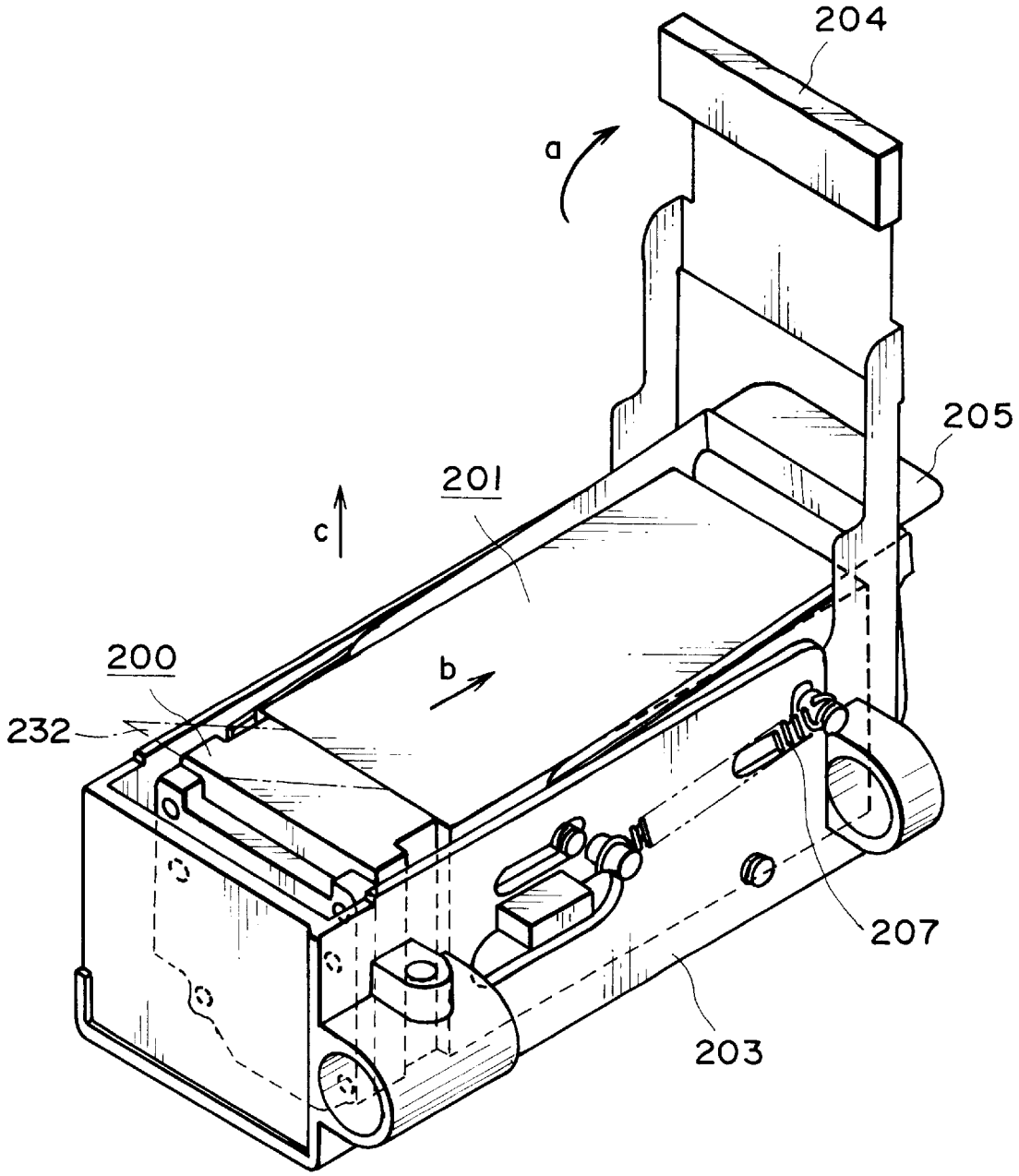
FIG. 20 is a perspective view illustrating an exchanging method in a first type in the first embodiment apparatus.

FIG. 20 is a perspective view of the manipulation in this mode, that is, the recording head 200 and the ink container 201 are taken out as a unit. In this case, the head lever 204 is rotated in the direction a in FIG. 20 from the state of FIG. 15 to an upright position, so that a cam of the head lever 204 moves the shaft on the lever having pushed the recording head 200, by which the pressure to the recording head by the head holder spring 207 is released.

At this time, the container case 208 in the carriage 203 moves while the projection thereof is in engagement with the ink container guiding groove 224, and therefore, the recording head 200 and the ink container 201 move as a unit in a direction b in FIG. 20. Then, the engagement between the positioning pin 225 and the whole of the recording head 200 is released, so that the recording head 200 and the ink container 201 as a unit can be moved in a direction c in FIG. 20. Therefore, they can be released from the carriage (off-carriage). During the above operation, the entire head cartridge 202 can be easily taken out by means of pinching and pulling up the head tab 232 provided on the recording head 200. This head tab 232 is made of plastic material (for example, polyester), and its surface touching the flexible cable 211 is composed of material which is at least electrically insulating. During the recording operation, the head tab 232 remains between the head lever 205 and flexible cable 211, insulating electrically the flexible cable 211 while protecting it. In the off-carriage state, by application of force in the direction opposite from the connecting direction between the recording head 200 and the ink container 201, they can be separated from each other. Then, the element which is necessitated to replace is set in the manner described hereinbefore. Then, the unit is set on the carriage 203 in the reverse process, thus completing the exchanging operation.

In this embodiment, the urging force of the recording head 200 is released by the head lever 204. This is not limiting, but it is possible to directly move a lever for urging the recording head 200. In this embodiment, a head holder spring 207 is used to fix the recording head, but this is not limiting, and it is a possible alternative that it is fixed by a spring latch hook or the like.

The first mode is advantageous in that when only one of the recording head and the ink container necessitates the exchange, only one of them is exchangeable, and therefore, the first mode is economical.

In the second mode, the ink container 201 is separated from the recording head 200 while the recording head 200 is fixed on the carriage (on-carriage state). In this manner, only the ink container 201 is taken out.

Figure 21:
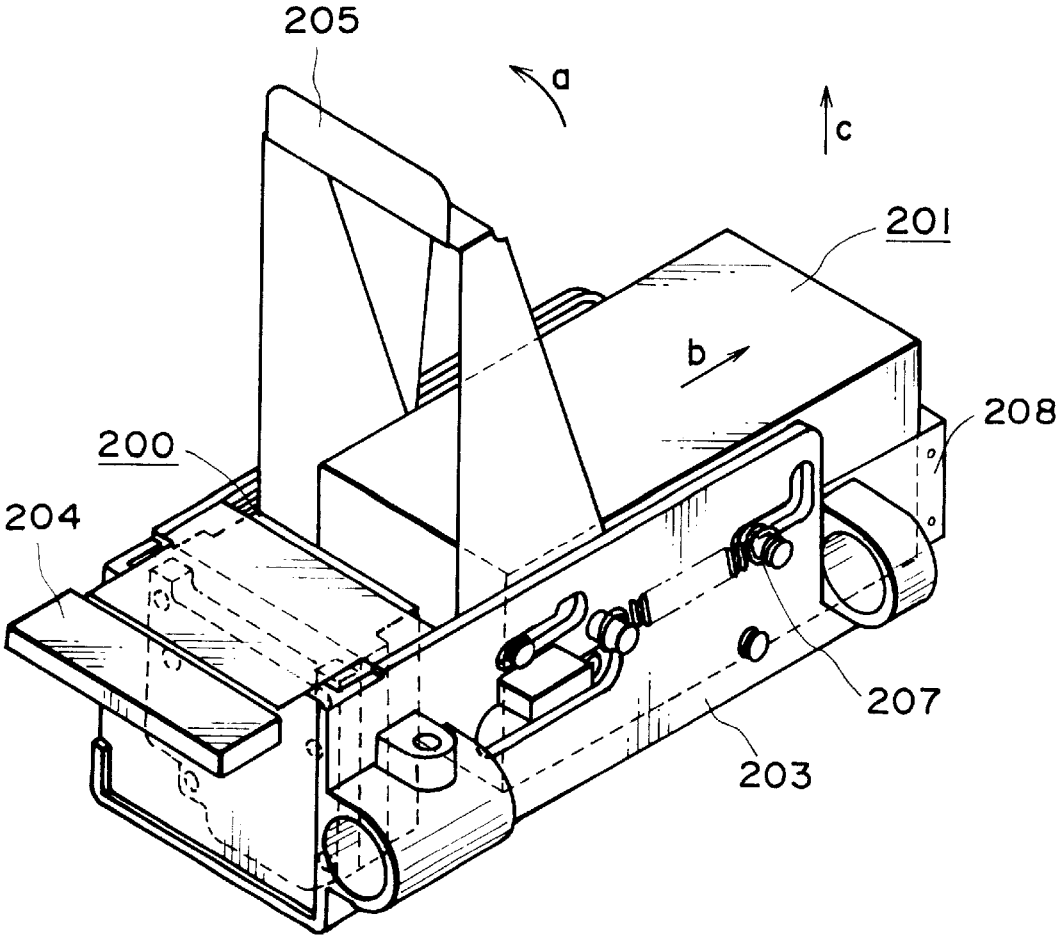
FIG. 21 is a perspective view illustrating an exchanging system in a second type in the first embodiment apparatus.

FIG. 21 is a perspective view in which the ink container 201 is separated from the recording head 200 on the carriage 203. In this case, the container lever 205 is rotated in a direction a in FIG. 21 from the state of FIG. 15 to the position shown in this figure. An unshown cam of the tank lever 205 moves the container case 208 in a direction b in FIG. 21. A projection of the container case 208 is engaged with the ink container guiding groove 224 in a side surface of the ink container 201, thus moving the ink container 201 in the direction b of FIG. 21. The fixing of the recording head 200 is the same as shown in FIG. 15, and therefore, it does not move together with the ink container 201. Then, the engagement between the recording head 200 and the ink container 201 is released, thus permitting separation therebetween. Further, the ink container 201 is moved in a direction c in FIG. 21, thus permitting it to be separated from the carriage 203.

When the ink container 201 is mounted, the ink container 201 is inserted into the container case 208 in the reverse order, and then, the container lever 205 is operated. This procedure causes the container case 208 to press the end of the ink container 201, and this pressure in turn causes the recording head 200 to unite with the ink container 201.

The second mode has, in addition to the advantages of the first mode, the following advantages. By properly designing the configuration of the cam of the container lever 205, the pulling speed upon the separation can be controlled, so that the ink scattering from the ink receiving port 220 and the ink supply port 221, can be prevented.

Since it is not necessary to grasp the recording head 200 directly with the operator's fingers, the possibility is eliminated that the ink ejection side surface of the recording head 200 is touched by the operator's finger, and therefore, the influence thereby to the printing quality can be prevented.

Because the portion of the ink container 201 which receives the force is limited, and therefore, only that portion is required to have sufficient mechanical strength, the thickness of the other portions can be reduced. This permits a light container with a large capacity.

Figure 18:
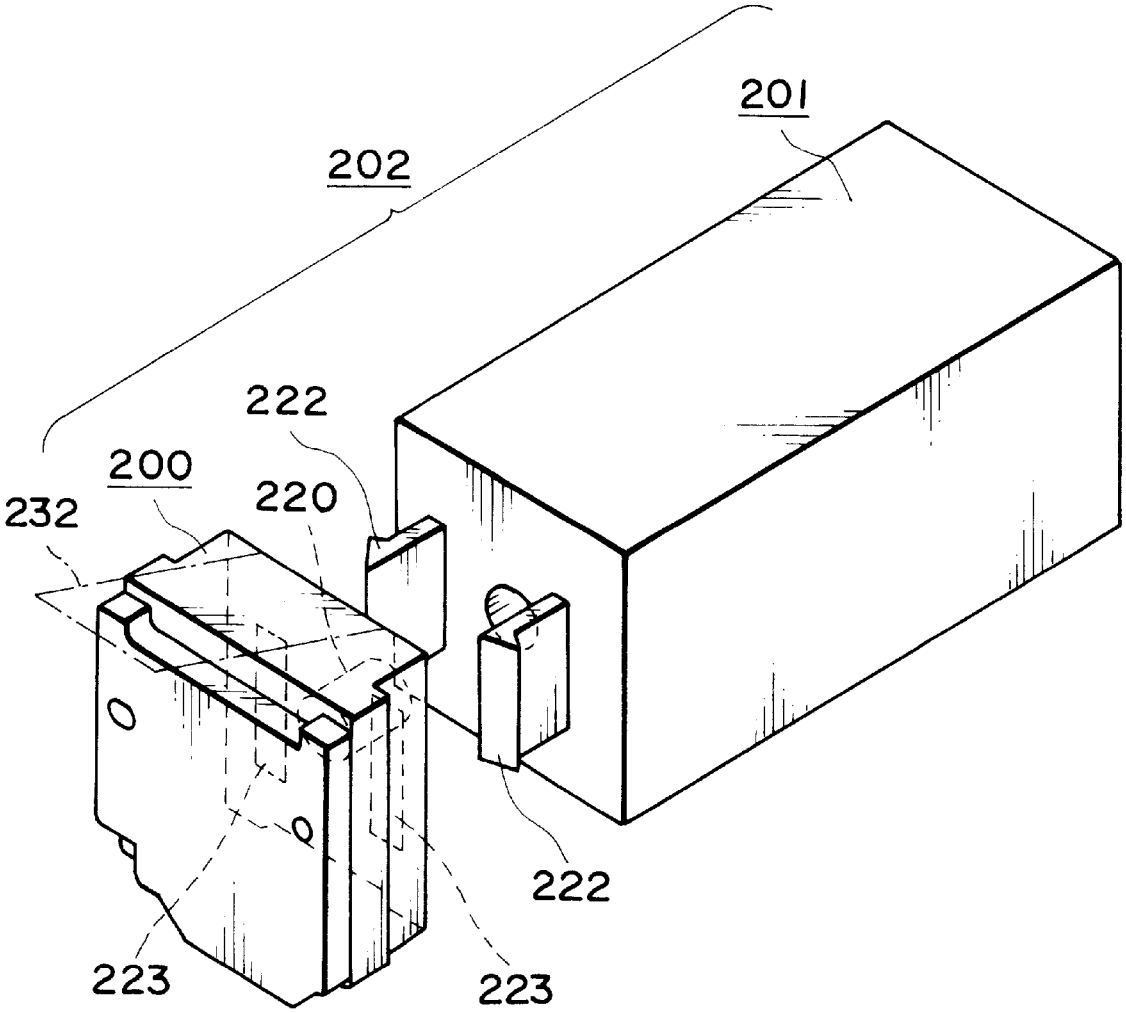
FIG. 18 is a perspective view of a recording head and an ink container, according to a further embodiment of the present invention.

Next, a description is given of the prevention of an inserting mistake which occurs when the ink container 201 is inserted into the container case 208 within the carrier 203. Referring to FIGS. 16 and 18, the ink container 201 has a surface having the ink supply port 221 to be connected to the recording head 200, and a surface without it, and therefore, the direction in which the ink container 201 is inserted must be more or less regulated by the arrangement of the connecting pawl 222 or the connecting pawl guide 223. In this embodiment, the inserting direction is restricted by means of providing the container case 208 with a tongue, and the ink container 201 with a cutout or groove (hereinafter, referred to as engaging portion).

Figure 22:
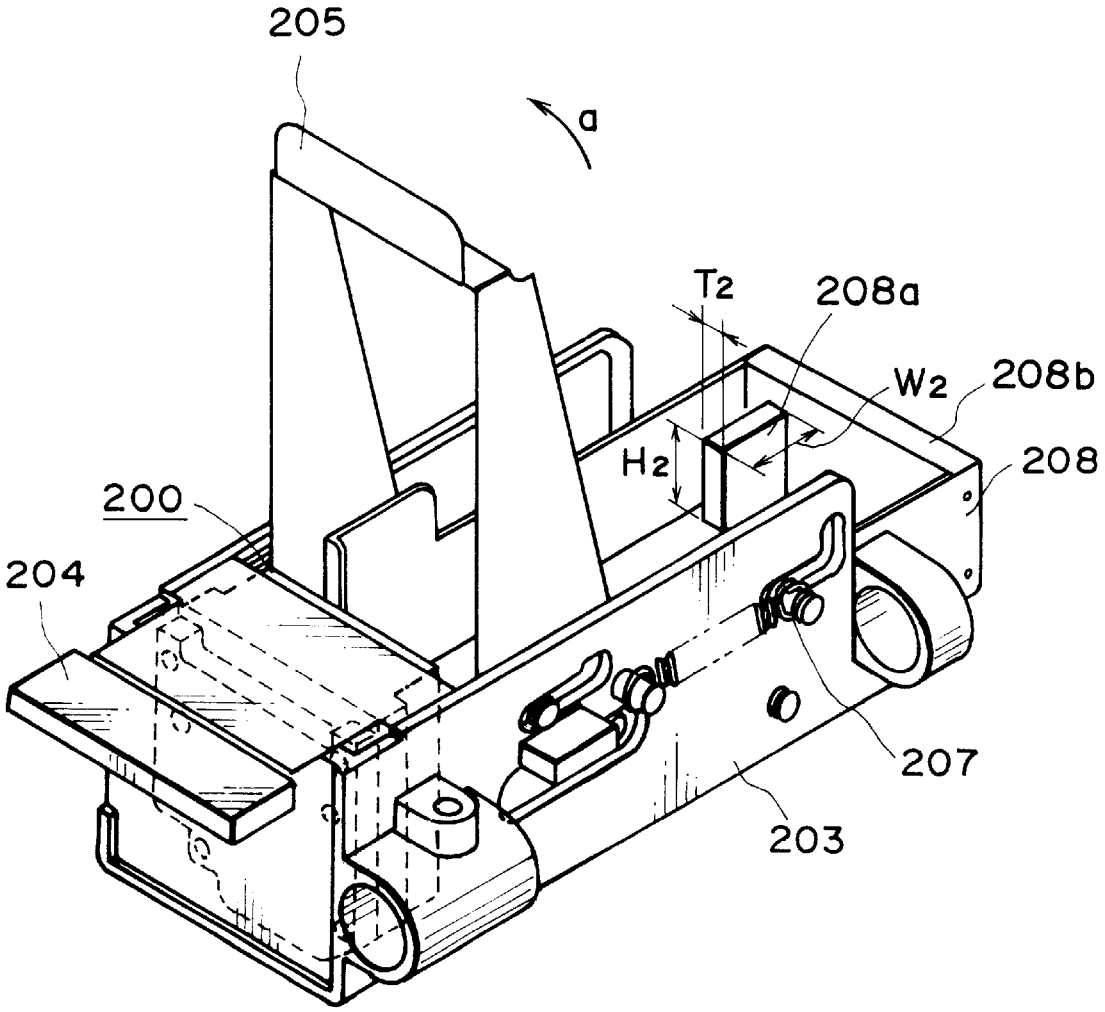
FIG. 22 is a perspective view of another type of carriage.

FIG. 22 is a schematic perspective view of the structure of the container case 208 constituting a part of the carrier 203. In this figure, a reference numeral 208*a* designates a container case end projection projecting as a guide within the container case 208, into the space where the ink container 201 is inserted, for regulating the inserting direction of the container; 208*b*, the container case end which defines the end of the container case 208 and presses the ink container 201 when the ink container 201 is inserted into the carrier 203, constituting together the container case 208. The container case 208 is substantially a rectangular parallelepiped measuring $H_2$ in height, $W_2$ in length, and $T_2$ in thickness. The shape is not limited to the rectangular parallelepiped. However, in order to restrict the direction in which the ink container 201 is inserted or moved, the shape is preferred to be such that the dimension in the direction in which the ink container 201 is moved (direction aligning with the recording head 200) is longer (in this embodiment, $W_2$ is longer than $T_2$).

Figure 23:
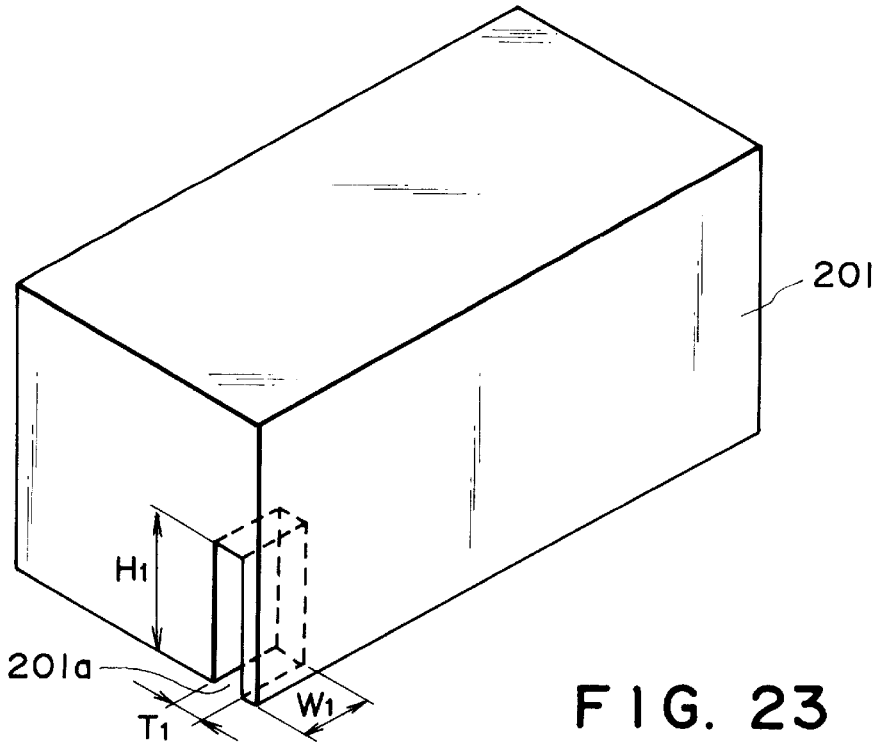
FIG. 23 is a perspective schematic view of an ink container, as seen from the side opposite to the one used when mounted on the recording head.

FIG. 23 is a schematic perspective view of the container case 208, as seen from the side opposite to the one which comes in contact with the recording head 200. In this figure, a reference numeral 201*a* designates an ink container slit cut inward of the ink container 201. The ink container slit 201*a* is substantially a rectangular parallelepiped measuring $H_1$ in height, $W_1$ in length, and $T_2$ in gap. Its shape is not limited to the rectangular parallelepiped.

The inserting direction is restricted by the container case end projection 208*a* and the ink container slit 201*a*. When the ink container 201 is inserted in the correct direction, the container case end projection 208*a* fits into the ink container slit 201*a,* allowing the ink container 201 to be stored in the container case 208. However, if the ink container 201 is inserted in the wrong direction, the container case end projection 208*a* is not accommodated by the external configuration of the ink container 201, not allowing the ink container 201 to be fitted, and therefore, the operator realizes that the ink container 201 has been inserted in the wrong direction, preventing machine damage or machine troubles which may be caused by the forceful insertion of the ink container 201 in the wrong direction.

Next, dimensional restrictions are discussed with reference to the container case 208 and the ink container 201.

Figure 24:
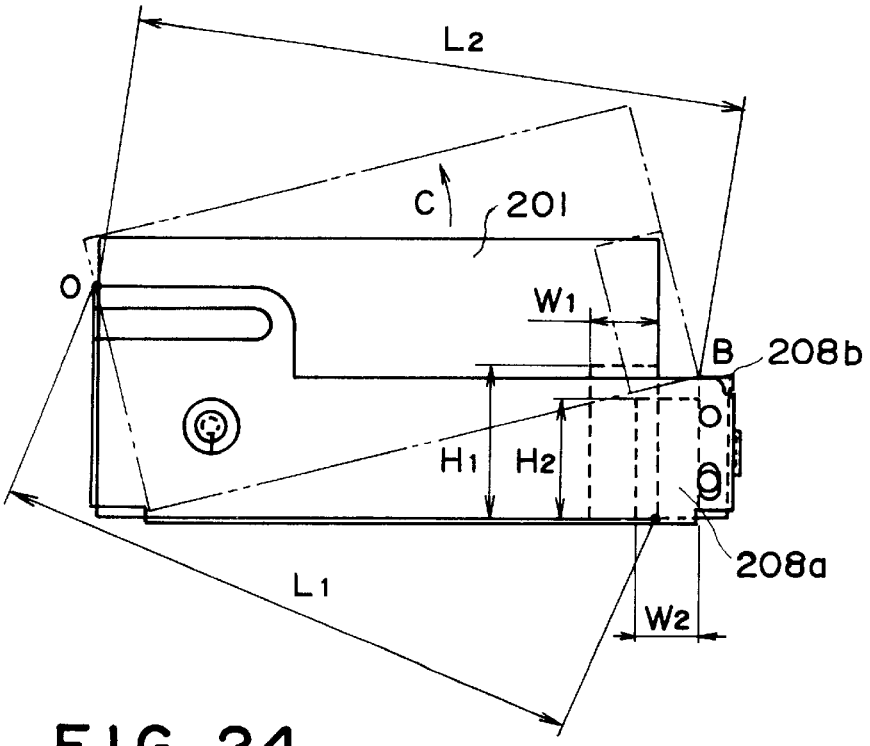
FIG. 24 is a schematic view of an ink container case of the carriage, showing its dimension.

FIG. 24 is a schematic plan view of the container case 208 and the ink container 201, giving the essential measurements. In this figure, a position O is a point which becomes a rotational center when the ink container 201 is rotated (direction indicated by an arrow c) on the side opposite to the one facing the recording head 200; a position A, a lower corner of the ink container 201, on the side away from the recording head 200; a position B, an upper corner of the container case end 208*b,* on the side facing the ink container 201; and a length $L_1$, the distance from the position O to the position A; and a length $L_2$ is the distance from the position O to the position B.

Figure 25:
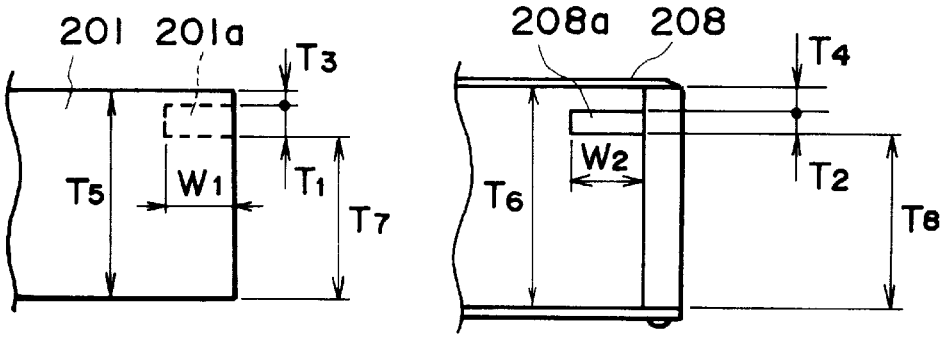
FIG. 25 shows the dimensions of the portion of the ink container case and ink container.

FIG. 25 is a schematic front view of the container case 208 and the ink container 201, giving the essential measurements. In this figure, a length $T_3$ is the distance from the side surface of the ink container 201 to the ink container slit 201*a;* a length $T_4$, the distance from the internal surface of the container case 208 to the container case end projection 208*a;* a length $T_5$, width of the ink container 201; a length $T_6$, the internal width of the container case 208; a length $T_7$, the distance from the side surface, opposite to the $T_3$, of the ink container 201 to the ink container slit 201*a;* and a length $T_8$ is the distance from the internal surface, opposite to the $T_4$, of the internal surface of the container case 208 to the container case end projection 208*a*.

Referring to FIG. 24, if the relation between $L_1$ and $L_2$ is set up to satisfy the following condition:

$$(\text{Length } L_1)<(\text{Length } L_2)$$

the ink container 201 which, according to the prior art, could be taken out only by pulling straight up is enabled to be taken out by a rotational motion, improving thereby operability. However, while a longer $L_2$ improves the operability, it increases the size of the carrier 203, which in turn leads to the increase in the overall size of the apparatus. Therefore, the length $L_2$ is preferred to satisfy also the following relation:

$$(\text{Length } L_2)<(\text{Dimension of the ink container } \mathbf{201} \text{ in the primary scanning direction})\times 2.$$

As for the relation between the thickness $W_2$ of the container case end projection 208*a* and the length $W_1$, if the relation is set up to satisfy the following condition:

$$(\text{Length } W_1)>(\text{Length } W_2)$$

the end of the ink container 201 can be pressed by the container case end 208*b* regardless of presence or absence of the projection for preventing the insertion mistake, and therefore, a constant and stable pressure can be obtained, affording smooth mounting operations for the ink container 201 and the recording head 200. The relation between the lengths $H_1$ and $H_2$ will be discussed later.

Referring to FIG. 25, in order for the ink container 201 to be fitted within the container case 208, the relation between $T_5$ and $T_6$ must satisfy the following condition:

$$(\text{Length } T_5)<(\text{Length } T_6)$$

In addition, in order for the ink container 201 to be smoothly inserted without interference between the container case end projection 208*a* and the ink container 201, both of the following equations must be satisfied. That is, if, $$(\text{Length } T_2)+(\text{Length } T_4)<(\text{Length } T_1)+(\text{Length } T_3)$$

and $$(\text{Length } T_2)+(\text{Length } T_8)<(\text{Length } T_1)+(\text{Length } T_7)$$

then, the container case end projection 208*a* is enabled to be smoothly inserted into the ink container slit 201*a*.

Figure 26:
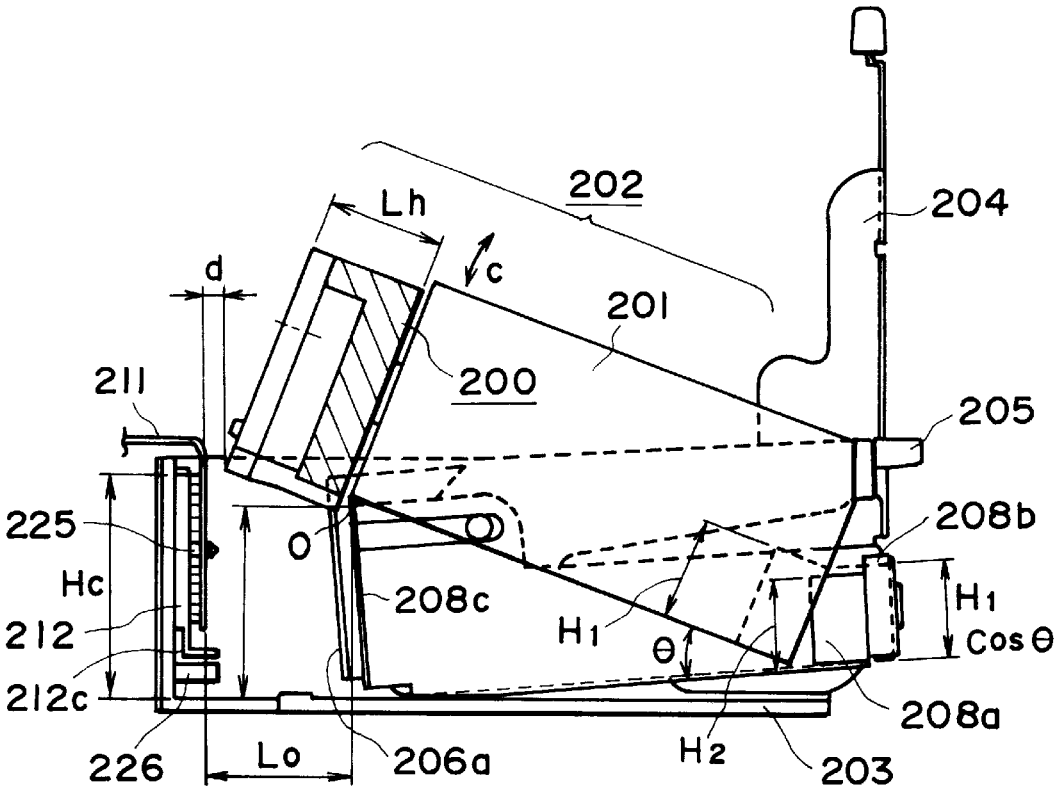
FIG. 26 shows the dimensions of the carriage and head cartridge.

Next, the dimensional restrictions with reference to the head cartridge 202 and the carrier 203 are discussed. FIG. 26 is a schematic front view of the head cartridge 202 and the carrier 203, giving the essential measurements. In this figure, a reference numeral 208*c* designates a container case projection provided at the end of the container case 208 and engaged with the end of the ink container 201; 206*c*, a head holder projection provided at the end of the head holder 206 for pressing the recording head 200; and the position O is the upper corner of the container case 208 which becomes the rotational center in FIG. 24.

In FIG. 26, the head cartridge 202 is shown on its way to be mounted on the carrier 203 (or to be demounted from), wherein the head cartridge 202 is inserted or pulled out as it is inclined by being rotated θ° in the direction indicated by an arrow C. Also, the mounting or demounting of the head cartridge 202 can be accomplished just by a simple vertical movement without the rotative motion.

In FIG. 26, regarding the mounting or demounting operation involving the rotative motion, the relation between $H_1$ and $H_2$ described with reference to FIG. 27 needs to be: $H_1>H_2$, and in addition, if the following relation is satisfied:

$$(\text{Length } H_1)\times\cos\theta>(\text{Length } H_2)$$

the container end projection 208*a* and the ink container 201 does not interfere with each other during the operation for mounting or demounting the head cartridge 202.

Hereinbefore, the description was given of the relation between the container case projection 208*a* as a guiding portion and its adjacent area, and of the configuration of the engaging portion of the ink container. However, the engaging portion of the ink container is preferred to satisfy also the following condition.

That is, in order to enable the ink container to be installed into or removed from the container case through the rotation motion, it is desirable that the above mentioned engaging portion 201*a* is open on the container case end side (the side opposite to the one connected to the head), as shown in FIGS. 24 and 26.

The wall designated by the thickness $T_3$ in FIG. 25, which is a part of the wall of the engaging portion 201*a*, may not be present in the consideration of ease of the operation to mounting the ink container into the container case, but it is preferable to be present in consideration of the role it plays as the guide for preventing the inserting mistake. Further, its thickness $T_3$ is preferred to be no less than 0.5 mm, since an excessively thin thickness does not offer sufficient strength.

As for the measurements of $T_3$ and $T_4$, $T_4$ is preferred to be no less than 0.5 mm larger than $T_3$ in order to allow the easy entry of $T_3$. $T_1$ is desired to be no less than 0.5 mm, preferably 1.0 mm, larger than $T_2$ because of the same reason.

In this embodiment, the essential measurements for the container case end are: $W_2$=4.1 mm, $T_2$=1.0 mm, $T_4$=1.7 mm, $T_8$=16.5 mm, $T_6$=18.2 mm, and $H_2$=7.8 mm, and the corresponding measurements for the portions adjacent to the engaging portions of the container are: $W_1$=4.5 mm, $T_1$=2.0 mm, $T_3$=1.0 mm, $T_5$=17.8 mm, $T_7$=15.2 mm, and $H_1$=9.2 mm.

Further, when the head cartridge 202 is mounted or demounted, if the ink is adhering around the ink ejection outlets of the printing head 200, there is a possibility that this adhering ink may end up adhering to the contact portion of the flexible cable 211, and may cause an electrical short circuit. Therefore, it is preferred that the clearance d between the tip of the recording head 200 and the flexible cable 211 is set up to remain to be more than 0 even during the mounting or demounting operation. During the mounting or demounting operation, the container case projection 208*a* and head holder projection 206*a* are allowed to pass only through the area indicated by the solidus in the head cartridge 202 in FIG. 26. Therefore, if a distance $L_0$ from the position O to the contact surface of the flexible cable 211 and a length $L_h$ of the recording head 200 are chosen to satisfy the following relation:

$$(\text{Length } L_0)-(\text{Length } L_h)>0$$

and in addition, if a height $H_O$ of the position O and a maximum height $H_c$ of the contact surface of the flexible cable 211 are chosen to satisfy the following relation:

$$(\text{Length } H_0)+(\text{Length } L_h)\times\sin\theta>(\text{Length } H_c),$$

the ink adhesion can be prevented.

Next, a description is given of the sliding portions of the carrier 203 and guide rail 2. FIG. 27 is a schematic front view of the carrier 203, as seen from the sheet discharging side. FIG. 28 is a side view of the same. In these figures, a reference numeral 233 designates an upper carrier rib provided on the carrier 203, on its surface on the sheet discharging side; 234, a lower carrier rib provided in the same manner; 235, an upper carrier slider which contacts and slides along the guide rail 2, and serves thereby as a guide when the carrier is moved in the primary scanning direction; and 236 is a lower carrier slider which also serves as a guide holding a minute clearance during the movement of the carrier.

The upper carrier rib 233 and lower carrier rib 234 face the guide rail 2, with a minute clearance which can normally prevent contact. However, since the upper carrier rib 233 extends over the substantial length of the side surface of the carrier 203, it serves as reinforcement for the side surface of the carrier 203.

In order to support only the weight of the carrier 203 itself while the normal printing operation is carried out, the presences of the upper carrier slider 235 and lower carrier slider 236 are sufficient. However, when the container lever 205 is operated for exchanging the ink container 201, or when the head lever 204 is operated for exchanging the head cartridge 202, a force far exceeding the carriage weight is imparted as the operational force, and therefore, there is a chance that the upper carrier slider 235 or lower carrier slider 236 may be damaged. In order for the upper carrier slider 235 or lower carrier slider 236 to withstand the larger load, it is only necessary to enlarge their contact surfaces. However, such a structure increases the contact resistance, impeding the sliding movement, and in addition, the clearance at the upper carrier slider 235 or lower carrier slider 236 becomes excessively small even with a slight inclination of the carrier 203, causing troubles such as seizing against the guide rail 2 or the like. Therefore, in this embodiment, the carrier ribs are provided at locations which afford a slightly larger clearance than the clearances at the sliding portions, so that when the carrier 203 is deformed by the excessive load, the upper carrier rib 233 or lower carrier rib 234 comes in contact with the guide rail 2, bearing the load and thereby preventing damage to the carrier 203.

By employing such a structure, sliding portions capable of withstanding a large load while reducing the contact surface area for the recording operation can be realized, and therefore, the sliding resistance can be reduced to improve reliability.

Hereinbefore, the descriptions were given of the structures of the carriage and discharge ink absorbing member in accordance with the present invention. Hereinafter, descriptions will be given of the placement of the recording head usable preferably with the present invention, arrangement of the ejection outlets in the head, and recording method using the head.

As to the placement of the recording head on the carriage, it was already described referring to FIG. 19. However, in this embodiment, stoppers 226 are provided, being inclined relative to the directions $X_1$ or $X_2$ in which the carrier 203 is moved. As for the nozzles #1–#m of the recording head 200, they are aligned with a predetermined pitch of P and also, in such a manner so that the nozzle alignment line is inclined to give the nozzle #m a deviation of d relative to the nozzle alignment length of H. Further, in order to assure precisely the predetermined amount of d, a distance G between the stoppers 226 is established to be larger relative to the nozzle alignment length.

Figure 29:
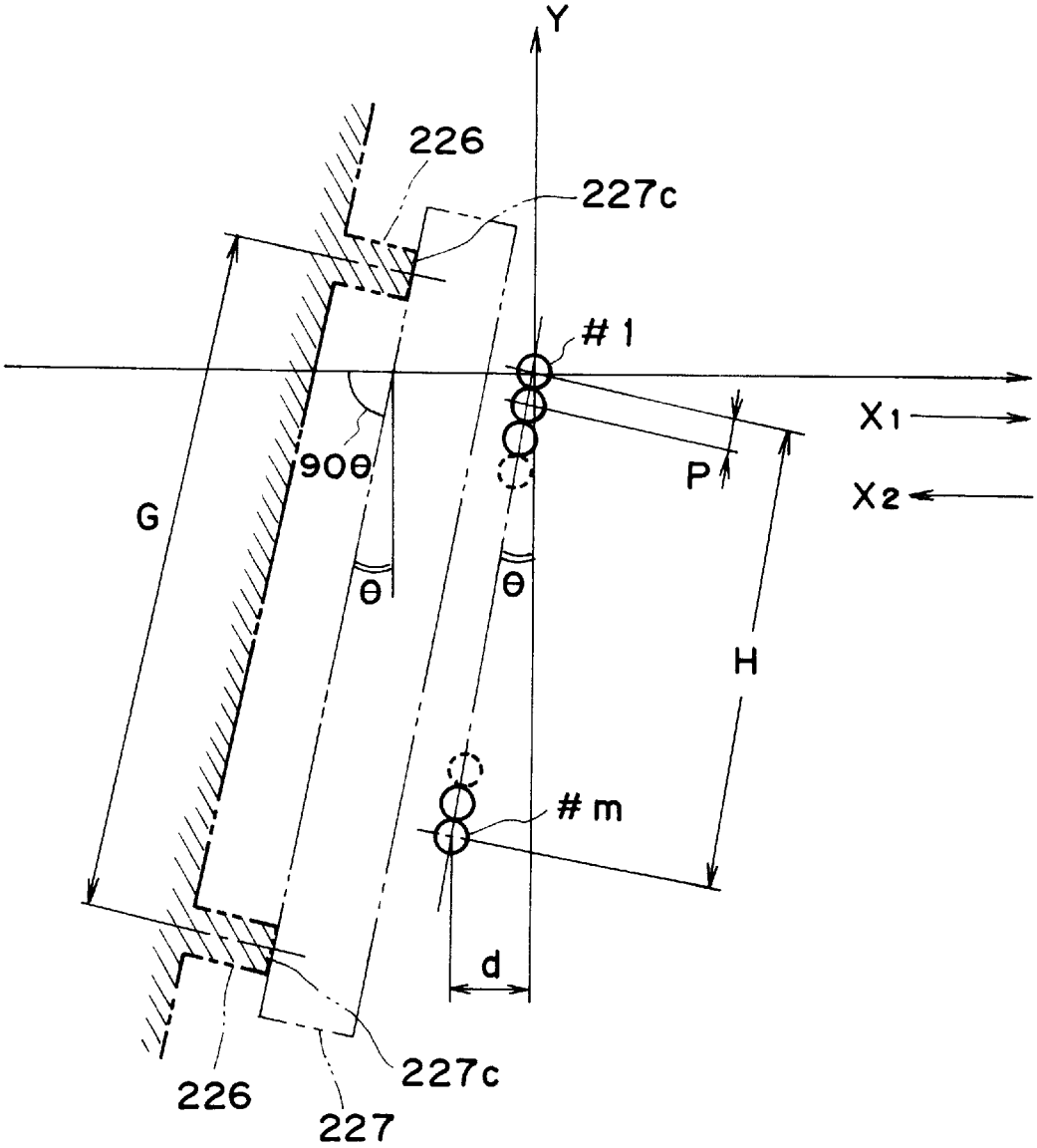
FIG. 29 schematically illustrates how the positional relation is determined between the carriage and head cartridge.
Figure 30:
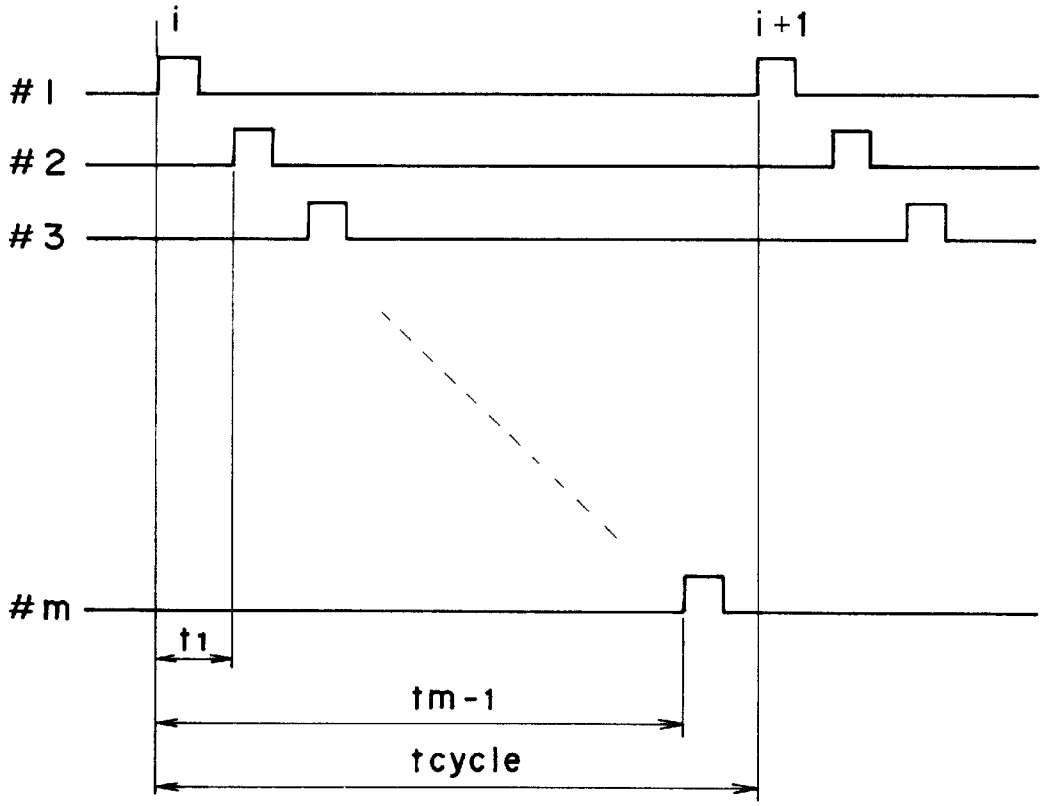
FIG. 30 is a timing chart for the ink ejection timing of the recording apparatus.

Below, the outline of the ejection control in the recording head is described referring to timing charts given in FIG. 8 and other figures following thereafter. FIG. 30 is an ejection timing chart for the recording head 202, and this timing chart produces a recording shown in FIG. 31 as it conveys the carrier 203 in the $X_1$ direction (refer to FIGS. 1 and 29).

Figure 31:
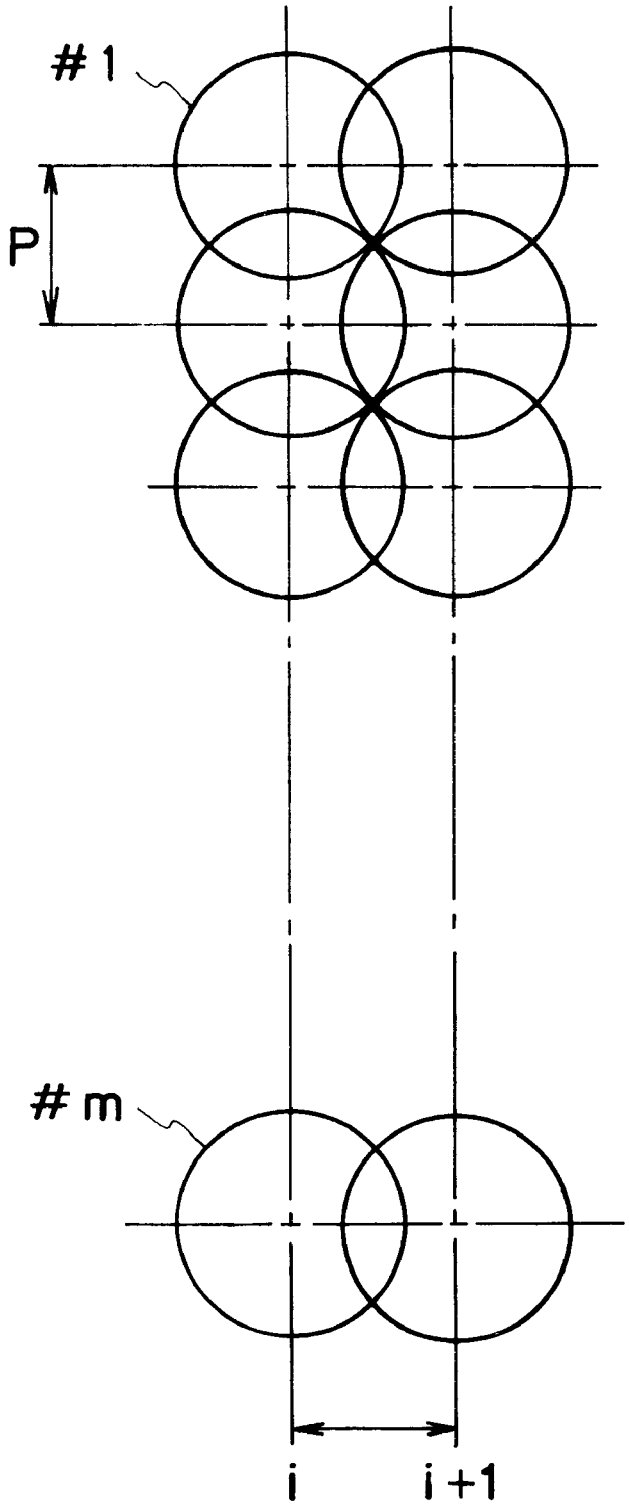
FIG. 31 is a schematic view of the alignment of the dots printed during the printing operation.

The ink is ejected from the nozzles in the order of #1 to #m. A reference code $t_1$ represents an ejection timing difference between the nozzles #1 and #2, and $t_{cycle}$ represents a nozzle ejection cycle of each nozzle. Normally speaking, it is preferable that the ejection timing difference between the adjacent nozzles is set constant, that is, $t_{m-1}=(m-1)\times t_1$. Here, if the ink is ejected at a rate of $t_{m-1}=d\times t_{cycle}/R$ as the carrier 203 is moved in the $x_1$ direction. at a speed of $R/t_{cycle}$, the deviation d (refer to FIG. 29) and the ejection timing difference $t_{m-1}$ cancel each other to produce a recording as shown in FIG. 31, without the inclination. When the recording is made by moving the carrier 203 in the $X_2$ direction, the ejection order has only to be reversed, ejecting thereby in the order of #m to #1.

When the recording speed is doubled without changing the resolution as is done in the case of a draft mode, if the ejection cycle is set at $t_{cycle}/2$, and the ink is ejected while the carrier 203 is moved in the $X_1$ direction at a speed of $2R/t_{cycle}$, the deviation d (refer to FIG. 29) of the nozzle #m and the ejection timing difference $t_{m-1}$ cancel each other to produce the recording as shown in FIG. 31, without the inclination.

The amount of the deviation d is preferred to be set according to the condition in which the ejection cycle of the nozzle is selected to be shortest. Further, in order to average the energy applied to the recording head and the ink supplied to the recording head, it is preferred to satisfy: $t_{m-1}=t_{cycle}/2$ $t_{cycle}$, and therefore, the deviation amount d is preferred to satisfy: d=R/2 R. Further, the nozzle pitch P is normally set to be R, and in this case, the deviation amount d is preferred to satisfy: d=2 P.

Thus, by means of changing the ejection timing corresponding to the recording speed or recording resolution, the recording can be produced without the recording position shift (inclination) caused by the nozzle ejection timing difference.

Figure 27:
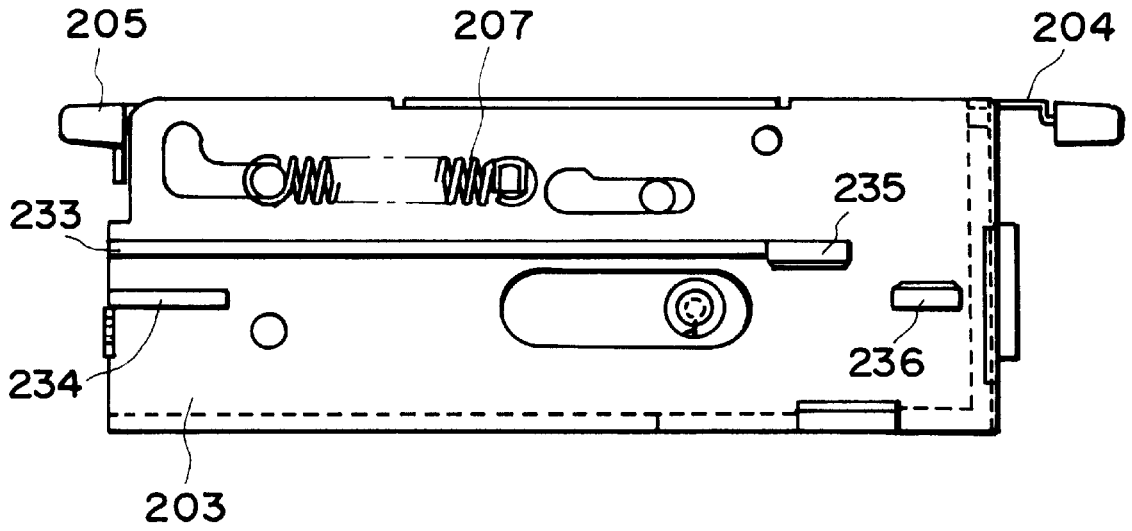
FIG. 27 is a schematic view of the carriage, as seen from the sheet discharging side of the recording apparatus.
Figure 28:
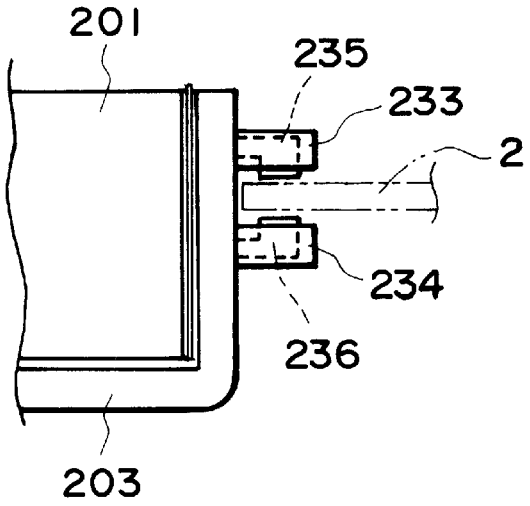
FIG. 28 is a schematic side view of the sliding portion of the carriage.

In FIG. 27, a case in which the alignment of the stoppers 226 is slanted is shown. However, it is also acceptable to align the stoppers 226 perpendicularly to the $X_1$ or $X_2$ direction in which the carrier is moved, and instead, the alignment of the nozzles is slanted with reference to the line connecting the stopper abutting portions 227*c* of the recording head 202.

In FIG. 1, a so-called serial type recording system, in which the ink is ejected from the recording head 200 while the carrier 203 on which the recording head 200 is moved in the direction perpendicular to the direction in which the recording material 3 is conveyed, is shown. However, the present invention can also be effectively applied to the line type recording system. In other words, referring to FIG. 29, by having the ink ejected with the timing shown in FIG. 30 while the recording material 3 is conveyed in the $X_2$ direction, with the recording head remaining fixed, the recording is produced without the recording position shift (inclination) caused by the ejection timing difference.

Figure 32:
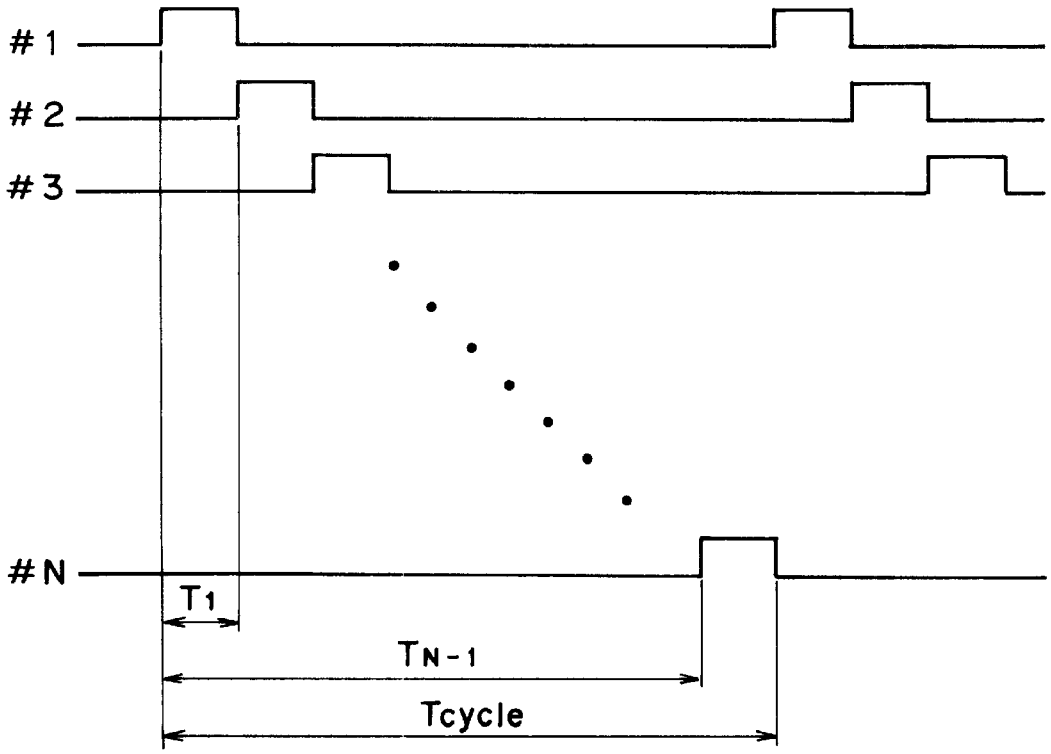
FIG. 32 is a timing chart for the ink ejection timing.
Figure 33:
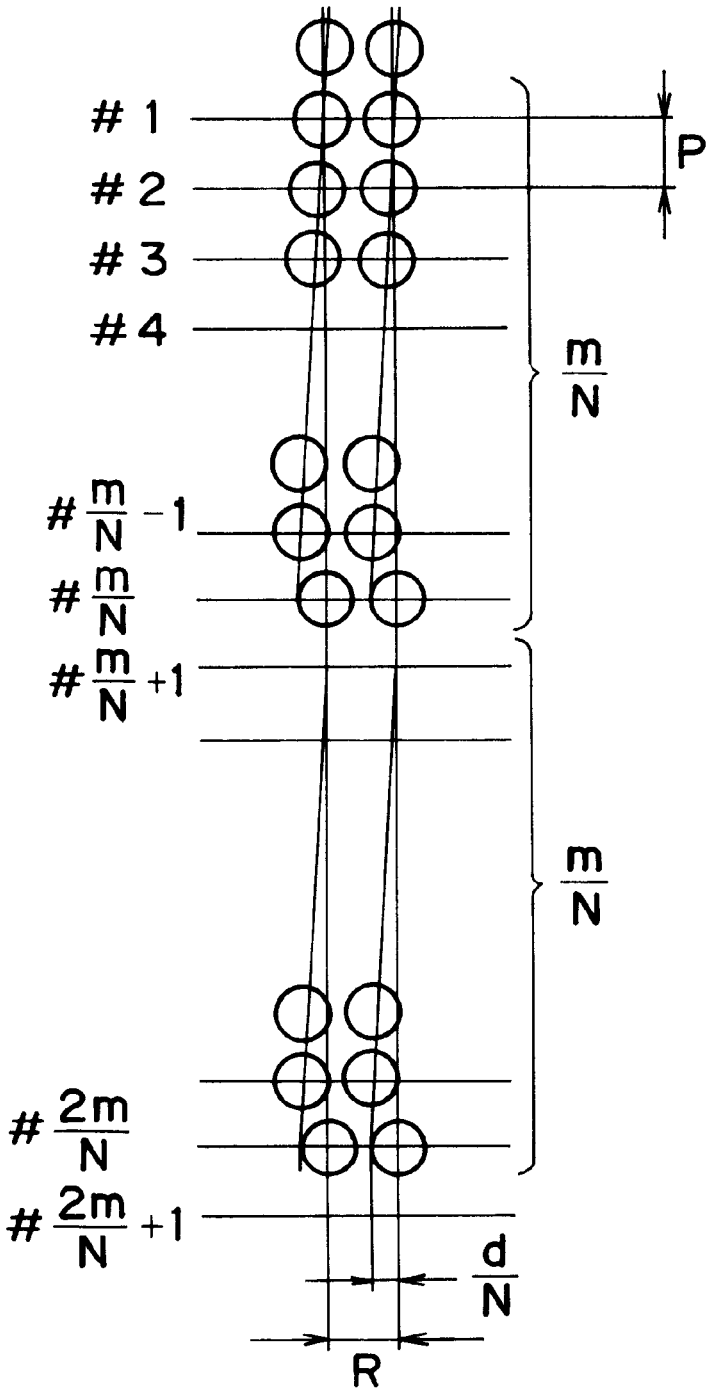
FIG. 33 is a schematic view of the alignment of the dots printed during the printing operation.

FIG. 32 shows another embodiment in which the nozzles of the recording head 200 are divided into N blocks of ejection groups, each comprising m/N nozzles. Since the ink is ejected from m/N nozzles at the same time within the same ejection group, the ejection timing difference between the nozzles #1 and #m can be shortened compared to the case in which the ink is ejected in a simple succession from #1 to #m, and therefore, the high speed recording can be realized. In this case, since the ink is ejected at the same time from m/N nozzles, the effect of deviation amount d is manifested in the recording. That is, the recording shows a deviation of d/N for every m/N dot. In order to improve the picture quality, the deviation amount d/N is desired to be no more than R/2. In other words, if d=R, the value of N is preferably no less than 2.

Figure 34A:
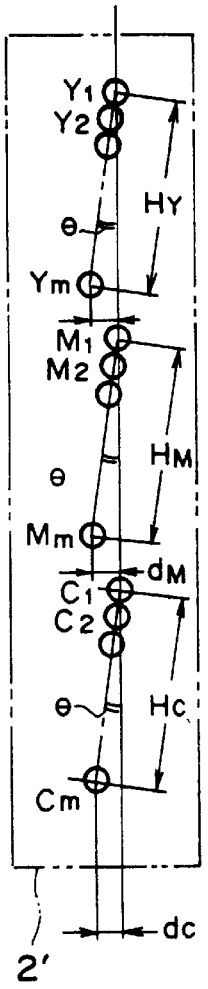
FIG. 34(*a*) shows a nozzle arrangement in a recording head, and FIG. 34 (*b*) is a timing chart for the ink ejection timing of the recording head.
Figure 34B:
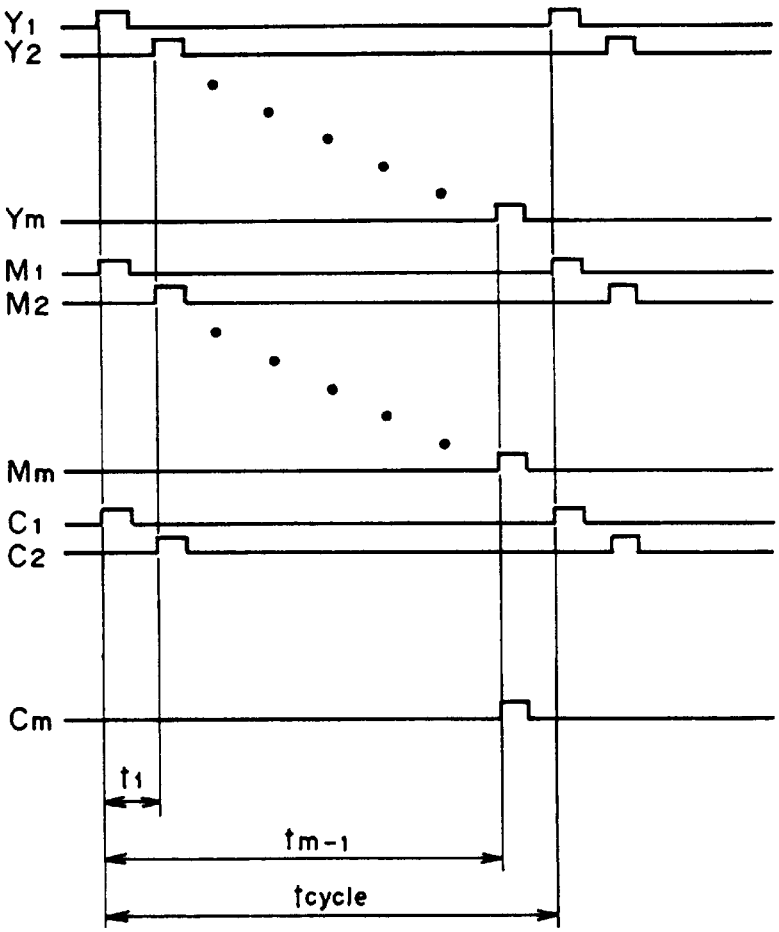

FIG. 34(*a*) shows another embodiment employing a recording head 200' in which nozzles are arranged to handle two or more inks of different colors. Reference numerals $Y_1$–$Y_m$ designate nozzles for ejecting yellow ink; $M_1$–$M_m$, nozzles for ejecting magenta ink; and $C_1$–$C_m$ are nozzles for ejecting cyan ink. The alignment of nozzles for each color is inclined by an angle of θ, and has a deviation of $d_Y$, $d_M$, or $d_C$, relative to the effective nozzle alignment length $H_Y$, $H_M$, or $H_C$, respectively. When the number of nozzles for each color is the same, if the ink is ejected, with a timing shown in FIG. 34(*b*), and also, with the nozzle alignment inclination and the ejection cycle satisfying: $t_{m-1}=d_Y\times t_{cycle}/R=d_M\times t_{cycle}/R=d_C\times t_{cycle}/R$, the recording can be produced without the recording position shift (inclination) caused by the ejection timing difference. Therefore, in this embodiment, the nozzles of the recording head can be integrally formed, in contrast to the recording head shown in FIG. 29, in which the recording heads are individually provided for respective recording colors, and the nozzles in respective heads are aligned in different lines with the inclination. Therefore, the head inclination accuracy is improved, which in turn improves accuracy in compensation for the recording position shift (inclination). In FIG. 34, the ejection timing for the recording head in which the number of nozzles for each color is the same is given. However, the number of nozzles may be different for each color. In such a case, the recording having no recording position shift (inclination) can be accomplished by means of establishing the ejection timing difference to be constant between adjacent nozzles.

Figure 35A:
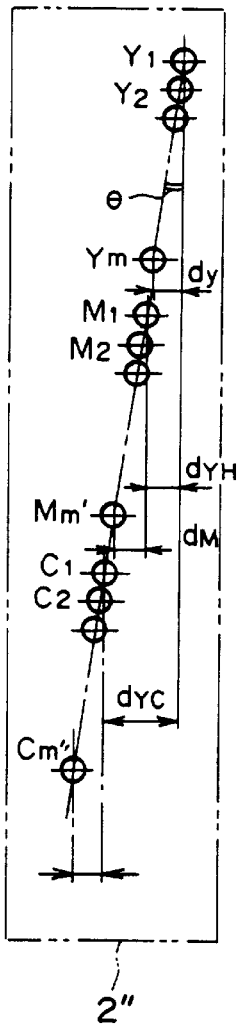
FIG. 35(*a*) shows another nozzle arrangement in the recording head, and FIG. 35(*b*) is a timing chart for the ink ejection timing of the recording head.
Figure 35B:
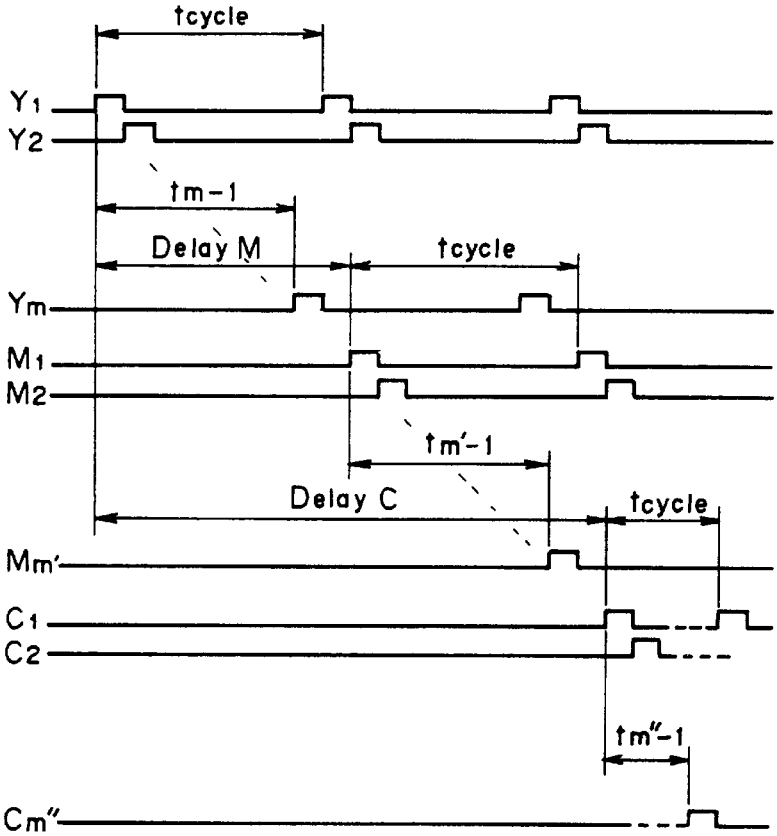
Figure 36B:
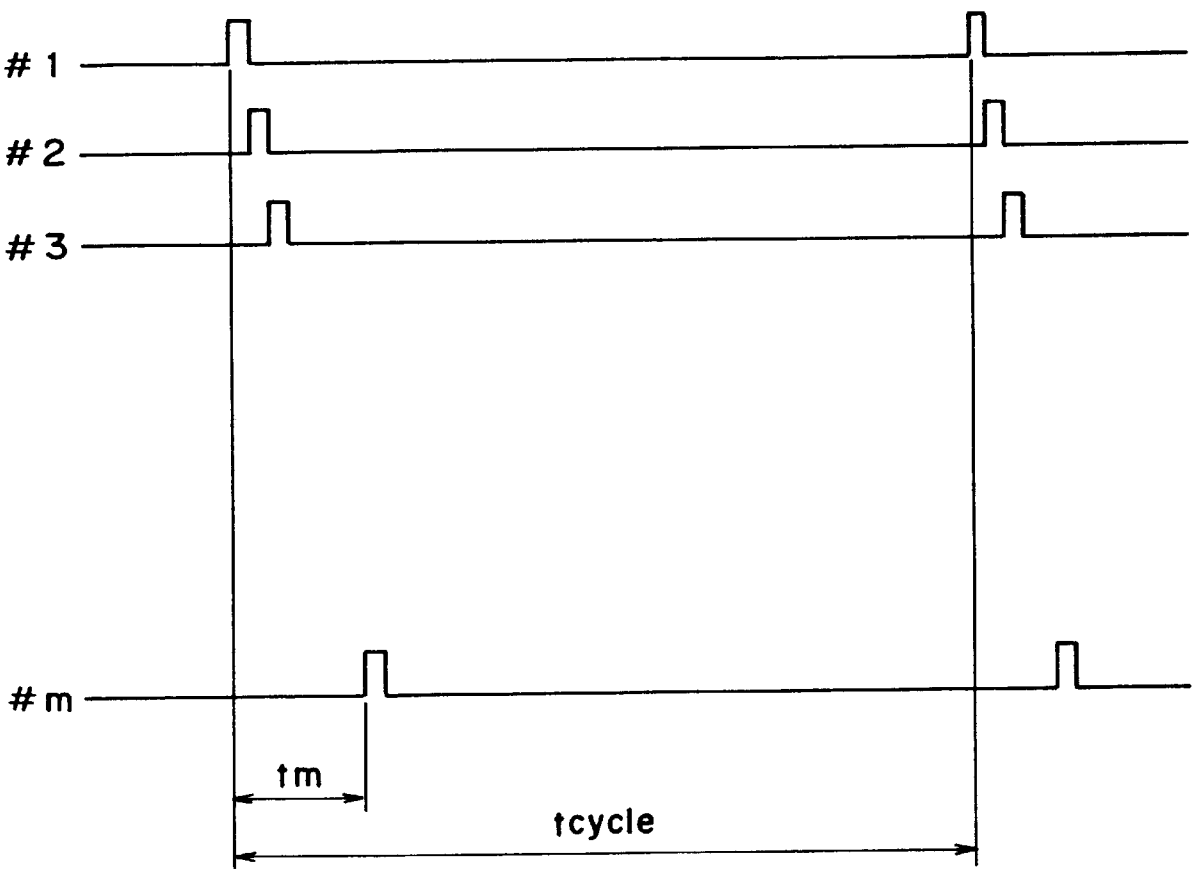
FIG. 36(*a*) shows another nozzle arrangement in the recording head, and FIG. 36(*b*) is a timing chart for the ink ejection timing of the recording head.
Figure 36A:
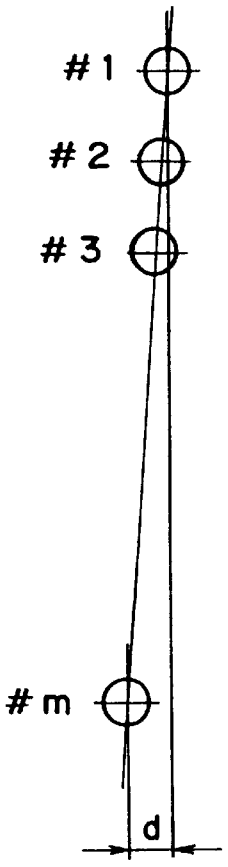

FIG. 35 illustrates an embodiment employing a recording head 200" in which nozzles for different color inks are aligned in a single line. Reference numerals $Y_1$–$Y_M$ designate nozzles for ejecting the yellow ink; $M_1$–$M_m$, nozzles for ejecting the magenta ink; and $C_1$–$C_m$ are nozzles for ejecting the cyan ink. The alignment of these nozzles are inclined by an angle of θ, that is, each nozzle has a deviation of $d_Y$, $d_M$, or $d_C$, with reference to the effective nozzle alignment length, and a deviation between $Y_1$ and $M_1$ is $d_{YM}$, and a deviation between $Y_1$ and $C_1$ is $d_{YC}$. Here, if the ink is ejected, with a timing as shown in FIG. 35(*b*), and with the nozzle deviation and ejection timing satisfying: $t_{m-1}=d_Y\times t_{cycle}/R$; $t_{m'-1}=d_M\times t_{cycle}/R$; $t_{m''-1}=d_C\times t_{cycle}/R$; Delay $M=d_{YM}\times t_{cycle}/R$; and Delay $C=d_{YC}\times t_{cycle}/R$, a recording having no recording position shift (inclination) due to the nozzle ejection timing difference can be produced. Since all the nozzles are aligned in a single line, its structure is simple and therefore, its manufacturing is easy, in contrast to the recording head 200' shown in FIG. 34. Further, the nozzle alignment inclination may be accomplished either by aligning the nozzles with an inclination within the recording head 200" or by slanting the head itself with reference to the recording apparatus as shown in FIG. 29.

Next, an apparatus employing a recording apparatus incorporating the aforementioned various elements will be described.

Figure 37:
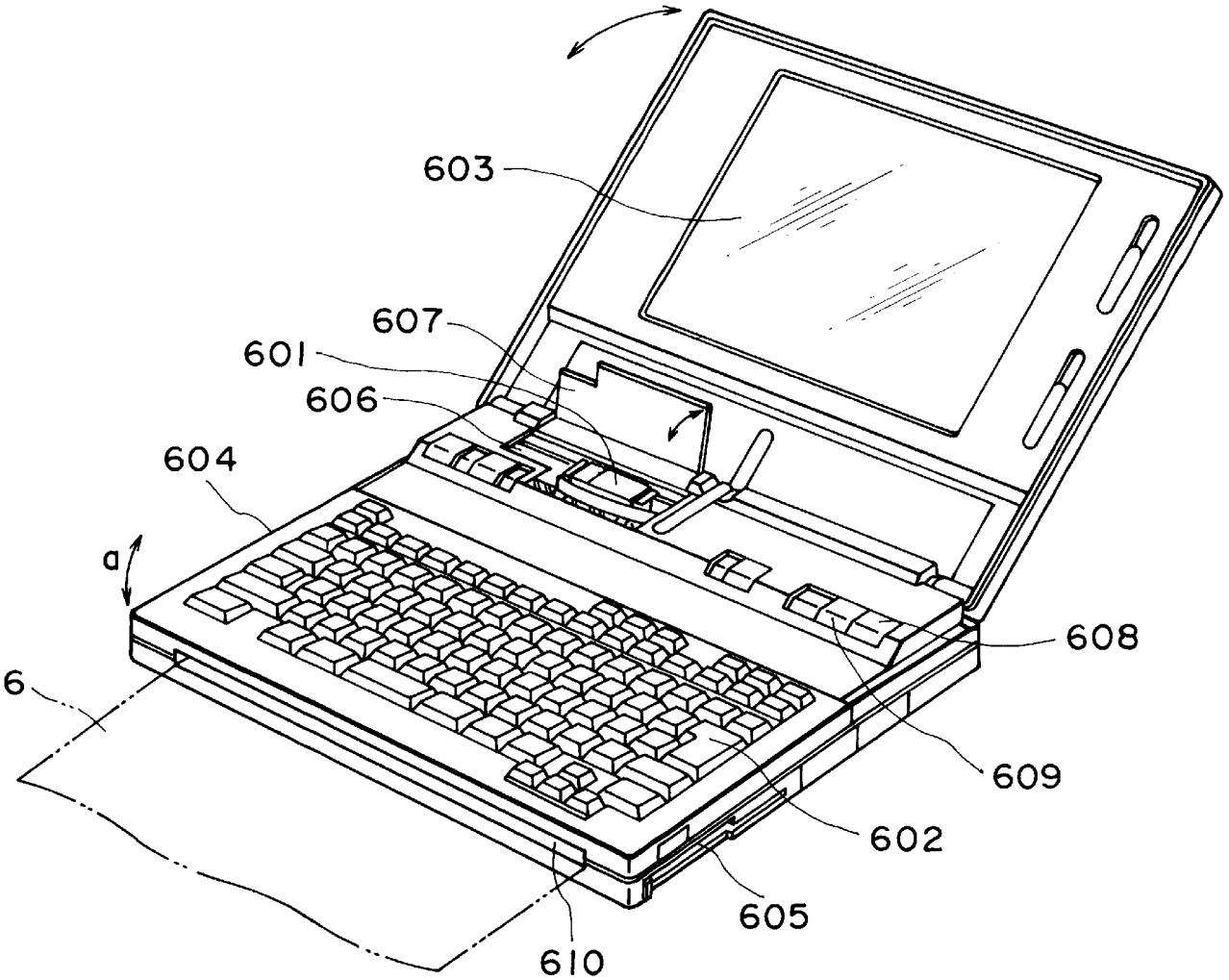
FIG. 37 is a perspective view of an information processing apparatus of the first embodiment in which the recording apparatus is incorporated.

FIG. 37 is a perspective view of an outer appearance of an information processing apparatus 604 incorporating the recording apparatus of this embodiment. In the figure, a reference numeral 601 designates a printer described above; 602, a keyboard provided with character and numerical keys, other character keys and command keys; 603, a display portion with a display; 606, a window for permitting exchange of the recording head 200 and/or the ink container 201 described hereinbefore; and 607, an openable cover for covering the window 606 other than when they are exchanged. The window 606 has a size enough to permit manipulation of the head lever 204 and the container lever 205 upon the ink container 201 exchange. A reference numeral 608 designates an exchanging switch for exchange of the recording head 200 and/or the ink container 201. When the exchanging switch 608 is actuated, the carriage motor 402*a* is driven, so that the carriage 203 is moved from the home position or the recording region to the window 606 position. At this position, when the exchange of the recording head 200 or the ink container 201 is completed, a release switch 609 is actuated. Then, the carriage 203 is returned to the home position, and thereafter, the recovery unit 271 carries out the recovery operation including sucking or ejecting the ink and wiping the recording head. Subsequently, the state before the exchange switch 608 is actuated, is established. The recording material is supplied to the printer 601 through a sheet supply port 610. The keyboard 602 is openable in a direction a for setting the recording material 6.

Figure 38:
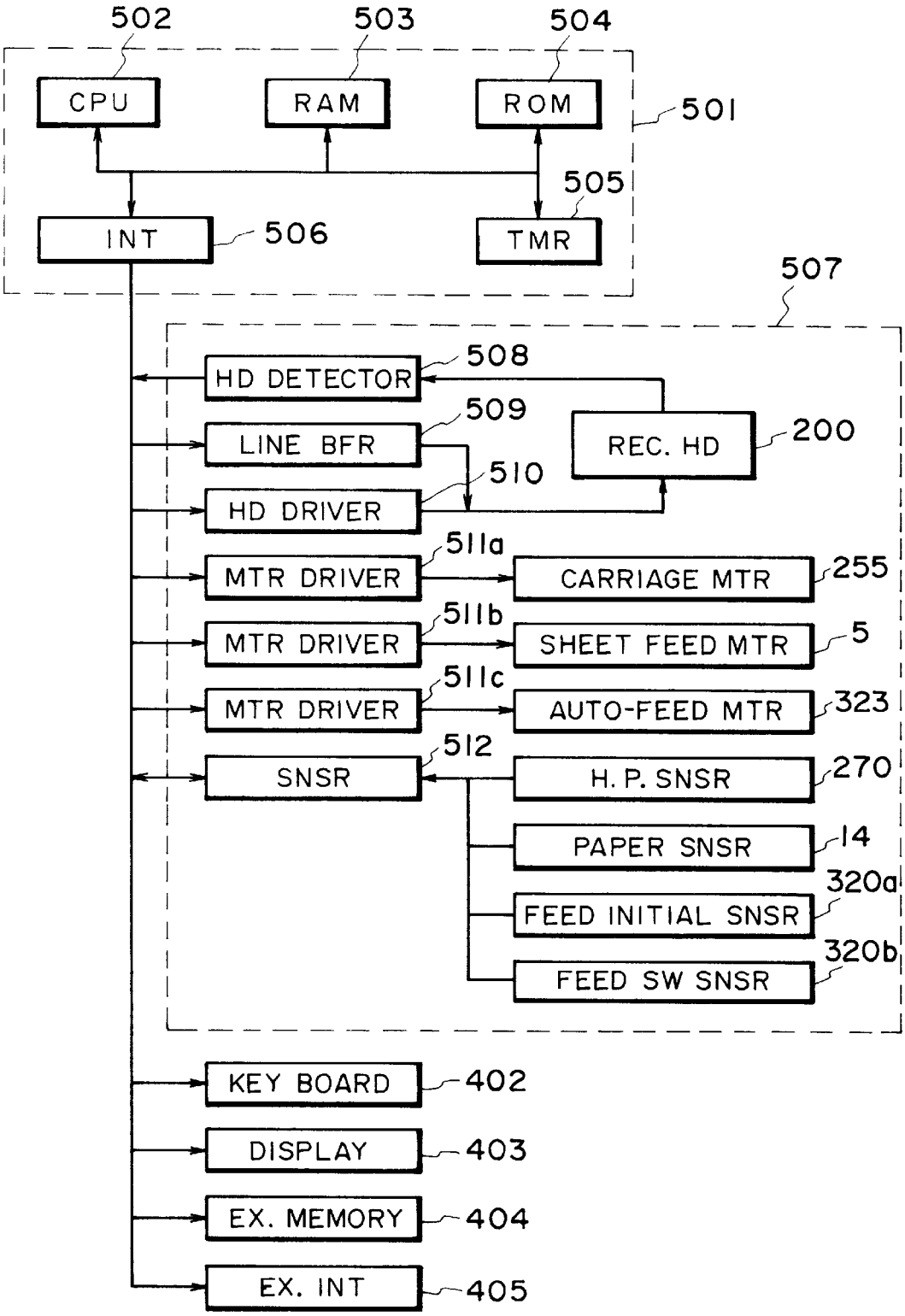
FIG. 38 is a block diagram of an electric circuit structure of the information processing device having the recording apparatus of the first embodiment therein.
Figure 39A:
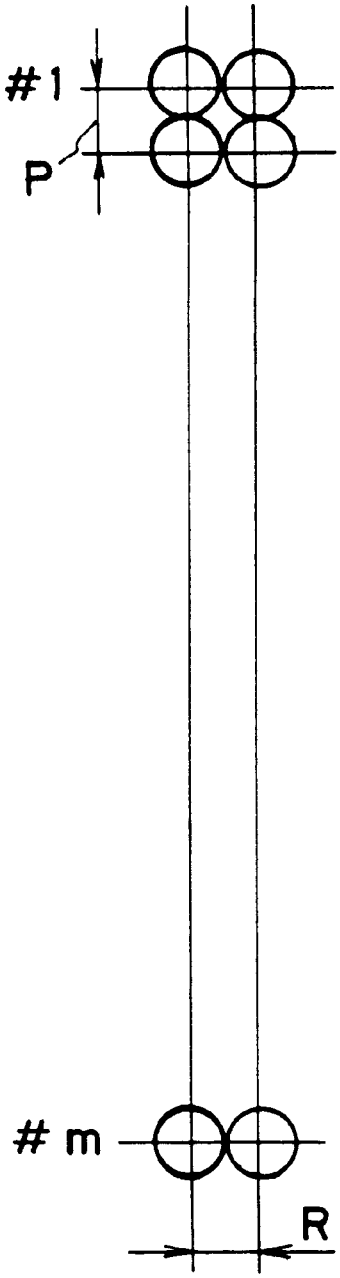
FIGS. 39(*a*) and 39(*b*) are schematic views of the alignment of printed dots, as printed using the prior art.
Figure 39B:
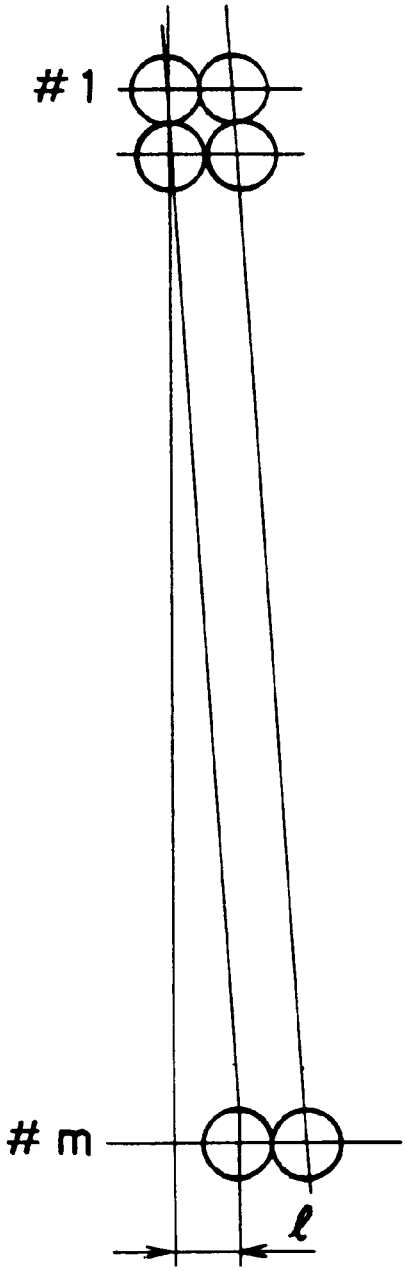

FIG. 38 is a block diagram of the electric circuit structure of the information processing apparatus. In this figure, a reference numeral 501 is a controller for the main control operation; 502, a CPU in the form of a microcomputer, for example, for carrying out various processes; 503, a RAM including an area for developing text data or image data and a work area; 504, a ROM for storing fixed data such as the program for the sequential operations and font data; 505, a timer for producing executing cycle of the CPU 502 and producing necessary timing for the recording operation of the printer 401; 506, an interface for supplying the signals from the CPU 502 to the peripheral device.

In addition, a reference numeral 507 designates a controller for the printer 401; 508, is a recording head detector for detecting information on the recording head such as outputs of sensors for detecting presence or absence of the recording head 200, the types thereof and the temperature thereof and outputs of the sensor for detecting presence or absence of the ink in the ink container 201; 509, a line buffer for storing record data for the recording head 200; 510, a head driver for supplying the recording signal and the electric power to the recording head 200; 511*a*, 511*b* and 511*c* are motor drivers for supplying necessary signals and electric power for operation of the carriage motor 255, the sheet feeding motor 5 and automatic sheet feed motor 323; 512, sensor detectors for detecting outputs of sensors such as the home position sensor 270, the paper sensor 14, the sheet feed initial sensor 320*a*, the sheet feed switch sensor 320*b* or the like. Furthermore, a reference numeral 404 designates an external memory such as FDD, HDD, RAM card or the like; and 405 is an external interface for connection directly with another information processing apparatus or for connection directly with an internal bus to control the peripheral devices. Although not shown in the block diagram, there is a power source for supplying electric power to the above electric circuits. The power source may be in the form of a chargeable battery, a disposable dry battery or an AC source converter fixedly used with the main assembly of the information processing apparatus.

The present invention is particularly suitably usable in an ink jet recording head and recording apparatus wherein thermal energy by an electrothermal transducer, laser beam or the like is used to cause a change of state of the ink to eject or discharge the ink. This is because the high density of the picture elements and the high resolution of the recording are possible.

The typical structure and the operational principle are preferably the ones disclosed in U.S. Pat. Nos. 4,723,129 and 4,740,796. The principle and structure are applicable to a so-called on-demand type recording system and a continuous type recording system. Particularly, however, it is suitable for the on-demand type because the principle is such that at least one driving signal is applied to an electrothermal transducer disposed on a liquid (ink) retaining sheet or liquid passage, the driving signal being enough to provide such a quick temperature rise beyond a departure from nucleation boiling point, by which the thermal energy is provided by the electrothermal transducer to produce film boiling on the heating portion of the recording head, whereby a bubble can be formed in the liquid (ink) corresponding to each of the driving signals. By the production, development and contraction of the bubble, the liquid (ink) is ejected through an ejection outlet to produce at least one droplet. The driving signal is preferably in the form of a pulse, because the development and contraction of the bubble can be effected instantaneously, and therefore, the liquid (ink) can be ejected with quick response.

The driving signal in the form of the pulse is preferably such as disclosed in U.S. Pat. Nos. 4,463,359 and 4,345,262. In addition, the temperature increasing rate of the heating surface is preferably such as disclosed in U.S. Pat. No. 4,313,124.

The structure of the recording head may be as shown in U.S. Pat. Nos. 4,558,333 and 4,459,600 wherein the heating portion is disposed at a bent portion, as well as the structure of the combination of the ejection outlet, liquid passage and the electrothermal transducer as disclosed in the above-mentioned patents.

The present invention is applicable to a serial type recording head wherein the recording head is fixed on the main assembly, to a replaceable chip type recording head which is connected electrically with the main apparatus and can be supplied with the ink when it is mounted in the main assembly, or to a cartridge type recording head having an integral ink container.

The provision of the recovery means and/or the auxiliary means for the preliminary operation are preferable, because they can further stabilize the effects of the present invention. As for such means, there are capping means for the recording head, cleaning means therefor, pressurizing or suction means, and preliminary heating means which may be the electrothermal transducer, an additional heating element or a combination thereof. Also, means for effecting preliminary ejection (not for the recording operation) can stabilize the recording operation.

As regards the variation of the recording head mountable, it may be a single head corresponding to a single color ink, or may be plural heads corresponding to a plurality of ink materials having different recording colors or densities. The present invention is effectively applicable to an apparatus having at least one of a monochromatic mode mainly with black, a multi-color mode with different color ink materials and/or a full-color mode using the mixture of the colors, which may be an integrally formed recording unit or a combination of plural recording heads.

The ink jet recording apparatus may be used as an output terminal of an information processing apparatus such as computer or the like, as a copying apparatus combined with an image reader or the like, or as a facsimile machine having information sending and receiving functions.

By means of providing, as in this embodiment, the carriage with the carrier ribs which come in contact with the guide rails only when an excessive load is imparted on the carriage, the carriage is enabled to withstand the operational force imparted upon it during the operation for mounting or demounting the head cartridge, without increasing the apparatus size and without impeding the carriage movement, and therefore, the size reduction and reliability improvement can be effected in the apparatus.

Further, by means of regulating, as in this embodiment, the sizes of the ink container and ink container case, the ink container is enabled to be mounted or demounted using a rotating motion, effecting thereby the size reduction, improvement in the operability, or the like.

Further, by means of providing the carriage with the guide portions for guiding the ink container when the ink container is inserted into the carriage, and at the same time, providing the ink container with the corresponding engaging portions, the ink container can be mounted at a proper position, eliminating mistakes.

Further, by means of connecting the blade cleaner to the discharge ink absorbing member in such a manner as to allow the ink transfer, the ink absorption capacity of the blade cleaner can be increased, and therefore, the blade can be reliably cleaned for a longer period of time without a need for servicing the blade cleaner.

As described hereinbefore, the recording position drift (inclination) can be effectively canceled by aligning the nozzles of the recording head at a predetermined angle and changing the ejection timing of each nozzle or each group of nozzles corresponding to the recording speed or recording resolution.

Further, in the case of a recording head comprising different sets of nozzles for ejecting two or more inks of different colors, the recording position shift (inclination) can be effectively canceled by aligning the nozzles in the recording head at a predetermined angle and changing the ejection timing of each nozzle or each group of nozzles corresponding to the recording speed, recording resolution, and nozzle count for each color.

As will be understood from the foregoing, the present invention is not limited to the use with an ink jet recording head but is usable with recording heads of other types, such as a thermal transfer type recording head, in which the recording medium (ink ribbon) may replace the ink (recording medium) container.

While the invention has been described with reference to the structures disclosed herein, it is not confined to the details set forth and this application but is intended to cover such modifications or changes as may come within the purposes of the improvements or the scope of the following claims.

What is claimed is:

1. A recording apparatus having a carriage moving a recording head in a direction of movement along a sheet and carriage driving means for driving the carriage, comprising:

a guiding member extending in the direction of movement and having a sliding surface slidably supporting and guiding the carriage;

a sliding contact member provided on the carriage and being in sliding contact with said sliding surface of said guiding member to support the carriage; and a supporting member provided on the carriage, facing and spaced from said guiding member, said supporting member abutting said guiding member to support the carriage upon receipt by the carriage of a pressing force of a level greater than a predetermined level in a direction from said supporting member toward said guiding member and toward the sheet.

2. An apparatus according to claim 1, wherein said sliding contact member sandwiches said guiding member.

3. An apparatus according to claim 1, wherein said supporting member is disposed on opposite sides of said guiding member.

4. An apparatus according to claim 1, wherein said recording head comprises ink ejection outlets for ejecting ink.

5. An apparatus according to claim 4, wherein said recording head comprises an electrothermal transducer element for generating thermal energy for ejecting the ink.

6. A recording apparatus for effecting recording on a recording material on a platen with recording head driving means for moving a recording head along the platen, comprising:

a carriage for carrying the recording head;

moving means for moving said carriage in a direction of movement along the platen, a first pressing force in a predetermined direction less than a predetermined magnitude being received by said carriage during movement of said carriage;

a first guiding member, extending in the direction of movement of said carriage, and guiding said carriage;

a second guiding member extending in the direction of movement of said carriage and having a sliding surface slidably supporting and guiding said carriage;

a first sliding contact member, provided faced to and in contact with said first guiding member, on said carriage, to support said carriage;

a second sliding contact member, provided faced to said second guiding member, on said carriage, said second sliding contact member being in sliding contact with the sliding surface of said second guiding member; and a supporting member provided faced to said second guiding member, on said carriage and spaced from said sliding surface of said second guiding member, wherein said supporting member is spaced from said second guiding member during the movement of said carriage, and upon receipt by said carriage of a second pressing force in a direction parallel to the predetermined direction and transverse to a plane of contact between said second guiding member and said second sliding contact member, the second pressing force being larger than the first pressing force less than the predetermined magnitude received by said carriage during the movement, said supporting member contacts said second guiding member by displacement of said carriage due to the larger force received by said carriage.

7. An apparatus according to claim 6, wherein said second sliding contact member sandwiches said second guiding member.

8. An apparatus according to claim 6, wherein said supporting member is disposed on opposite sides of said second guiding member.

9. An apparatus according to claim 6, wherein said recording head comprises ink ejection outlets for ejecting ink.

10. An apparatus according to claim 9, wherein said recording head comprises an electrothermal transducer element for generating thermal energy for ejecting the ink.

11. An apparatus having a carriage for moving a head in a direction of movement along a sheet and carriage driving means for driving the carriage, comprising:

a guiding member extending in the direction of movement and having a sliding surface slidably supporting and guiding the carriage;

a sliding contact member provided on the carriage and being in sliding contact with said sliding surface of said guiding member to support the carriage; and a supporting member provided on the carriage, facing and spaced from said guiding member, said supporting member being disposed on opposite sides of said guiding member, said supporting member abutting said guiding member to support the carriage upon receipt by the carriage of a pressing force of a level greater than a predetermined level in directions from said supporting member toward and away from said guiding member and toward and away from the sheet.

12. An apparatus according to claim 11, wherein said sliding contact member sandwiches said guiding member.

13. An apparatus according to claim 11, wherein said recording head comprises ink ejection outlets for ejecting ink.

14. An apparatus according to claim 13, wherein said recording head comprises an electrothermal transducer element for generating thermal energy for ejecting the ink.

15. An apparatus having a carriage moving a head in a direction of movement along a sheet and carriage driving means for driving the carriage, comprising:

a guiding member extending in the direction of movement and having a sliding surface slidably supporting and guiding the carriage;

a sliding contact member provided on the carriage and being in sliding contact with said sliding surface of said guiding member to support the carriage; and a supporting member provided on the carriage, facing and spaced from said guiding member, said supporting member abutting said guiding member to support the carriage upon receipt by the carriage of a pressing force of a level greater than a predetermined level in a direction from said supporting member toward said guiding member and toward the sheet.

* * * * *